US008118489B2

(12) United States Patent
Waldron et al.

(10) Patent No.: US 8,118,489 B2
(45) Date of Patent: Feb. 21, 2012

(54) BAG

(75) Inventors: Matthew W. Waldron, Hamilton, OH (US); David J. Hoying, Cincinnati, OH (US); John Augustyn, Hinsdale, IL (US)

(73) Assignee: The Glad Products Company, Oakland, CA (US)

( * ) Notice: Subject to any disclaimer, the term of this patent is extended or adjusted under 35 U.S.C. 154(b) by 296 days.

(21) Appl. No.: 12/565,079

(22) Filed: Sep. 23, 2009

(65) Prior Publication Data

US 2011/0069912 A1 Mar. 24, 2011

(51) Int. Cl.
*B65D 33/28* (2006.01)
*B65D 25/14* (2006.01)

(52) U.S. Cl. ..... 383/75; 220/495.11

(58) Field of Classification Search ..... 383/75, 383/33; 229/495.11; 220/495.11
See application file for complete search history.

(56) References Cited

U.S. PATENT DOCUMENTS

| | | | | |
|---|---|---|---|---|
| 5,000,325 | A * | 3/1991 | D'Elia | 209/702 |
| 5,006,380 | A * | 4/1991 | Fraser | 428/35.2 |
| 5,040,902 | A * | 8/1991 | Eaton et al. | 383/7 |
| 5,120,138 | A * | 6/1992 | Midgley et al. | 383/7 |
| 5,133,607 | A | 7/1992 | Bonke | |
| 5,390,875 | A | 2/1995 | Gietman et al. | |
| 6,059,458 | A | 5/2000 | Belias et al. | |
| 6,402,377 | B1 | 6/2002 | Vo et al. | |
| 6,921,202 | B2 * | 7/2005 | Raterman | 383/33 |
| 6,939,042 | B2 | 9/2005 | Rusnak | |
| 6,966,697 | B2 | 11/2005 | Patridge et al. | |
| 6,994,469 | B2 * | 2/2006 | Sleight et al. | 383/43 |
| 7,946,765 | B2 * | 5/2011 | Melvan et al. | 383/43 |
| 2007/0036472 | A1 * | 2/2007 | Persenda | 383/33 |
| 2010/0303388 | A1 * | 12/2010 | Kent et al. | 383/32 |
| 2011/0091137 | A1 * | 4/2011 | Kent | 383/75 |

FOREIGN PATENT DOCUMENTS

WO WO2007/146877 12/2007

* cited by examiner

*Primary Examiner* — Jes F Pascua
(74) *Attorney, Agent, or Firm* — David Peterson

(57) ABSTRACT

The bag may include first and second sidewalls joined along a first side edge, a second side edge and a bottom edge. The sidewalls may be un-joined along their top edges to form an opening. When the bag is placed in a trash receptacle, the top edges may be folded over the rim of the receptacle. To assist with securing the bag to the receptacle, the bag may include an elongated elastic strap of elastic material attached by a first end to an attachment point proximate the first sidewall and by a second end to an attachment point proximate the second sidewall. The strap length and attachment point locations are selected so that, when the strap is in a relaxed state, the strap may not extend to the side edge. The strap may be stretched commensurate with the side edge when folding the top edges about the receptacle rim.

4 Claims, 32 Drawing Sheets

BAG

BACKGROUND

Among their many applications, it is known to use thermoplastic bags as disposable liners for trash canisters. The trash canisters are typically made from a rigid material like plastic or metal. The bags intended to be used as liners for such refuse containers are typically made from low-cost, pliable or flexible thermoplastic material. When the receptacle is full, the thermoplastic liner actually holding the trash may be removed for further disposal and replaced with a new liner.

When being utilized as a trash canister liner, it is important that the bag be secured in a manner that the bag can extend vertically within the canister so that items placed into the canister fall and collect at the bottom of the bag. Additionally, it is important that the bag does not unsecure or release itself with respect to the trash receptacle so as to fall into the trash receptacle. To avoid this problem, the open circumference of the bag is often folded over the lip or rim of the trash canister and may be tied thereto in order to retain the bag to the trash canister. However, tying knots into liner bags in order to secure them to the canister is an inconvenient and time consuming process.

Therefore, it is desirable to develop a simpler and quicker method of securing trash bag liners to trash canisters. It is also desirable to facilitate the interaction between an elastic securing material and the relatively inelastic film substrate to secure a trash bag liner to a trash canister. It is also desirable to implement the securing method in such a manner that it is inexpensive and may be facilitated in a high speed manufacturing environment.

BRIEF SUMMARY

A thermoplastic bag intended to be used as a trash receptacle liner may be made from a first sidewall of thermoplastic material overlaid and joined to a second sidewall of the same or similar material to provide an interior volume. To provide an opening for accessing the interior volume, a top edge of the first sidewall may remain un-joined to a corresponding top edge of the second sidewall. When the bag is laid flat, the first and second sidewalls may lay adjacent one another with the first and second top edges extending adjacent and parallel to each other. When inserting the bag into a trash receptacle, the first and second sidewalls may be pulled apart from each other to open the opening and expand the interior volume. To close the opening when, for example, disposing of the liner bag, the bag may include a draw-tape that may be accommodated in a hem formed about the opening along either or both of the un-joined first and second top edges.

To assist in securing the bag to the trash canister, the bag includes an elongated elastic strap or strip, the length of which may stretch and contract. The elastic strap may be attached only by its first end to a first attachment point associated with the first sidewall and by its second end to a second attachment point associated with the opposing second sidewall. In various embodiments, the ends of the elastic strap may be attached to the draw-tape, to the inner surface of the first or second sidewalls proximate the top opening, or to the outer surfaces of the first and second sidewalls proximate the opening. The intermediate portion of the elastic strap may remain unattached or loose and may extend across the bag opening. Because the elastic strap is only attached at two attachment points associated with the first and second sidewalls, the relaxed or contracted elastic strap will not cause the sidewall material to bunch or constrict together when the bag is laid flat and the first and second top edges are adjacent one another.

However, the length of the elastic strap when relaxed or contracted may be less than the maximum width of the opening when the first and second sidewalls are pulled apart to open the bag. When the bag is inserted or installed in a trash canister, the elastic strap may stretch or flex to allow the first and second top edges providing the opening to be folded over the rim of the canister. The elastic strap may then contract or relax due to its elastic or resilient characteristics to provide a gripping force about the periphery of the canister thereby securing the bag to the canister.

The bag with an elastic strap may be produced by a high speed manufacturing process that processes continuous sheet-like webs of thermoplastic material into the finished bag via automated equipment. The process may include equipment that folds the edges of the web to provide hems and that introduces the draw-tape into the hems. Additionally, the process may direct a continuous strip or pre-cut strips of elastic material to the web and may intermittently or discontinuously attach the strips to the draw-tape or proximate the hems. Additional processing steps may be included to produce the finished bag.

A possible advantage of the thermoplastic bag having the elastic strap is that it may better secure itself to the refuse container and may resist falling into the container. Another possible advantage is that the elastic strap may be attached in such a way that, in its relaxed state, it does not bunch or constrict the sidewall material when the bag is laid flat. These and other possible advantages and features of the disclosure will become apparent from the description and the accompanying drawings.

DESCRIPTION

Figure 1:
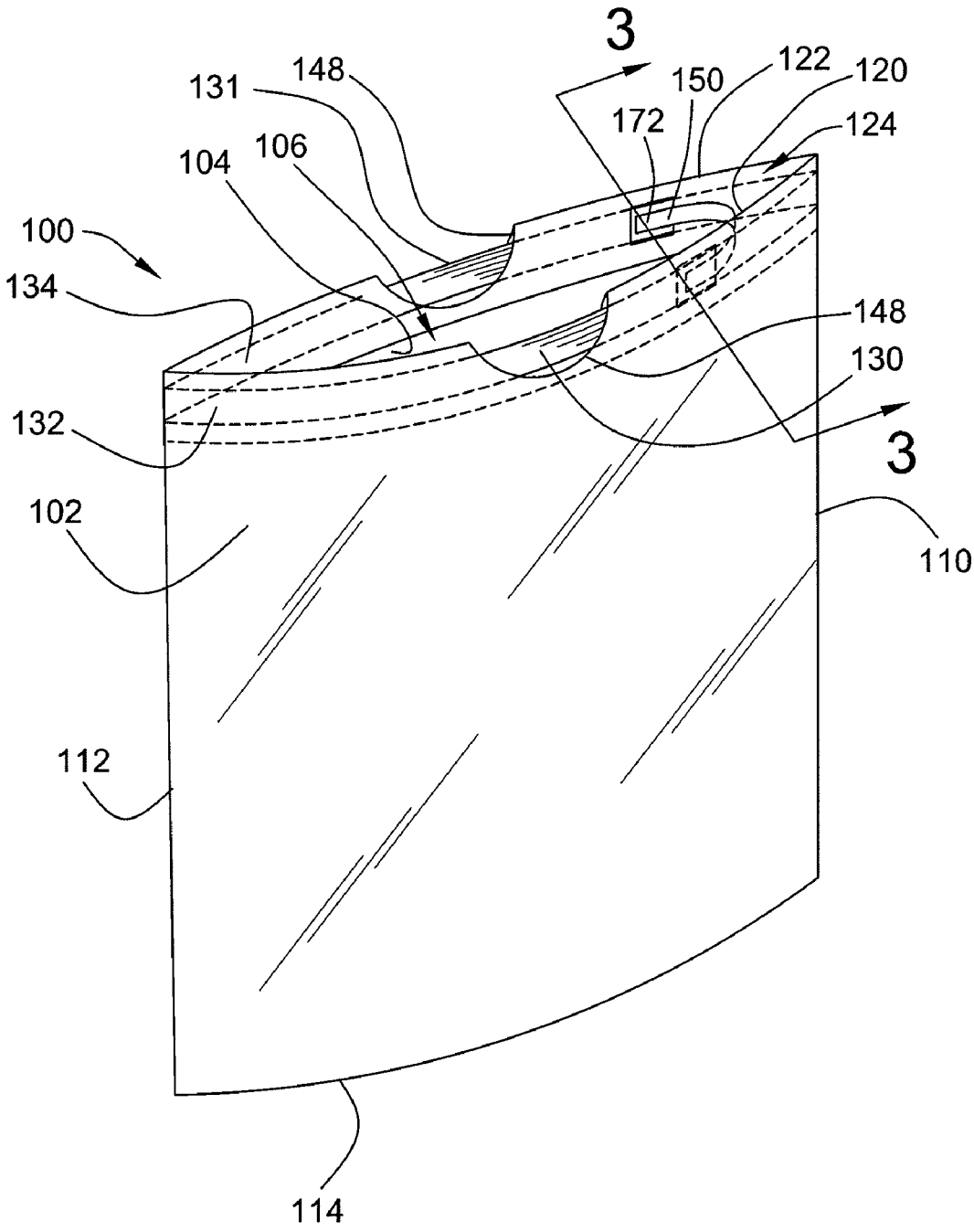
FIG. 1 is a perspective view of a thermoplastic bag adapted for use as a trash receptacle liner which includes an elastic strap attached to a draw tape accommodated in a hem formed about the opening of the bag.
Figure 2:
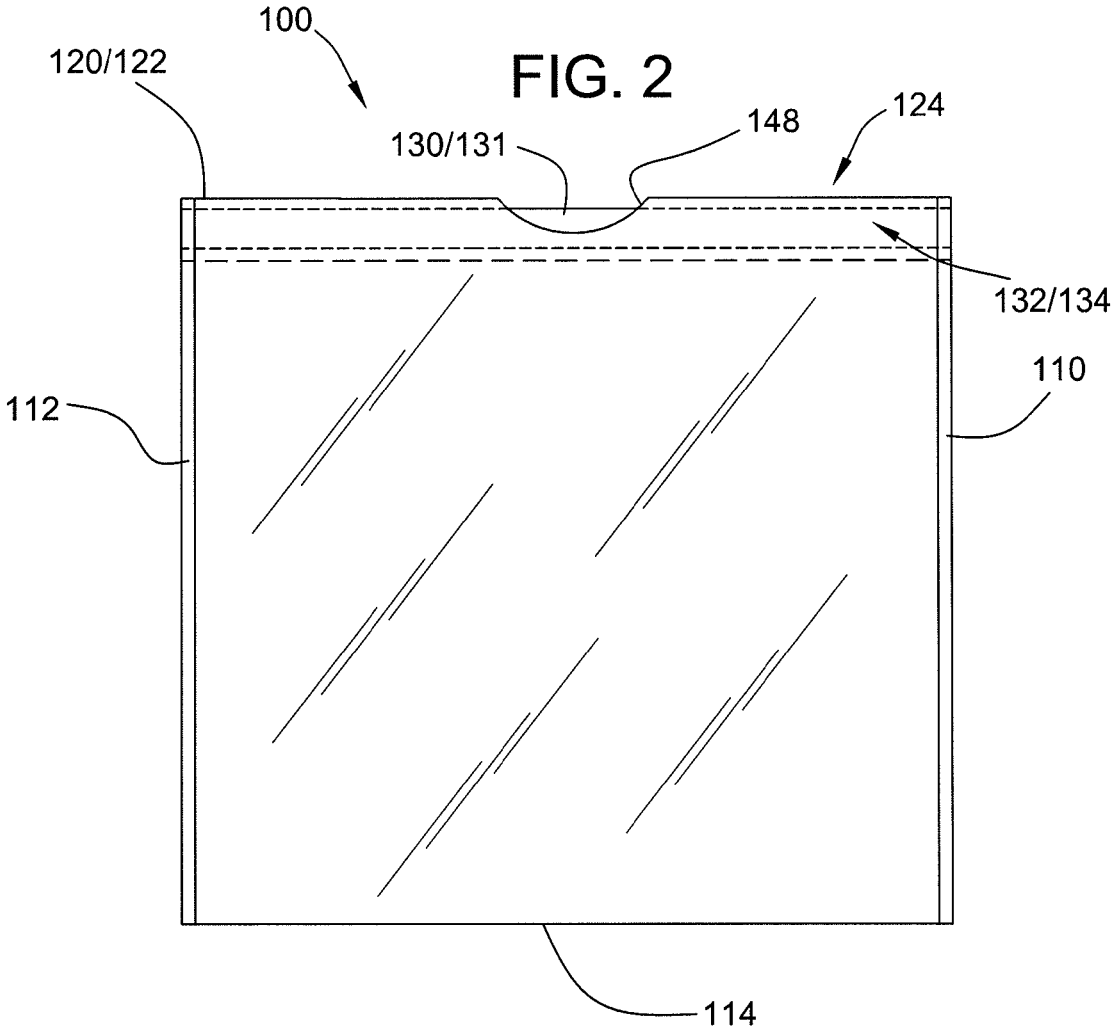
FIG. 2 is a front elevational view of the bag of FIG. 1 illustrating the bag as laid flat with the opposing sidewalls adjacent one another.

Referring to FIGS. 1 and 2, a thermoplastic bag 100 may be used as a liner for trash receptacles and refuse containers. The bag 100 may be made from a first sidewall 102 and an opposing, second sidewall 104 that may be overlaid and may be joined to the first sidewall to define an interior volume 106 for holding trash. In the illustrated embodiment, the first and second sidewalls are rectangular in shape, but in other embodiments may have other suitable shapes. The first and second sidewalls 102, 104 may be joined together along a first side edge 110, a second side edge 112 spaced apart from the first side edge, and a bottom edge 114 that extends between the first and second side seals. The sidewalls 102, 104 may be joined along their edges by any suitable joining process such as, for example, heat sealing in which the thermoplastic material bonds or melts together. Other sealing or joining processes may include ultrasonic methods and adhesive.

The first and second sidewalls 102, 104 may be made of flexible or pliable thermoplastic material formed or drawn into a smooth, thin-walled web or sheet. Examples of suitable thermoplastic materials may include polyethylenes, such as, high density polyethylene, low density polyethylene, linear low density polyethylene, very low density polyethylene, polypropylene, ethylene vinyl acetate, nylon, polyester, ethylene vinyl alcohol, or ethylene-methyl acrylate, and may be formed in combinations and in single or multiple layers. When used as a garbage can liner, the thermoplastic material may typically be opaque but may also be transparent, translucent, or tinted. Furthermore, the material used for the sidewalls may be a gas impermeable material and may include other features such as being treated with deodorants and/or disinfectants as is sometimes desirable in the production of trash can liners.

To access the interior volume 106, the top edges 120, 122 may remain un-joined to provide an opening 124. The un-joined top edges 120, 122 may be separated or pulled apart to open the bag 100. To close the opening 124 when, for example, disposing of a filled liner bag, the bag may include one or more draw tapes 130, 131 along the opening. The draw tapes 130, 131 may be accommodated within first and second hems 132, 134 formed along the respective first and second top edges 120, 122. The draw tapes 130, 131 may each be an elongated elastic tape of flexible, thermoplastic material which may be pulled to cinch closed the opening 124.

Figure 3:
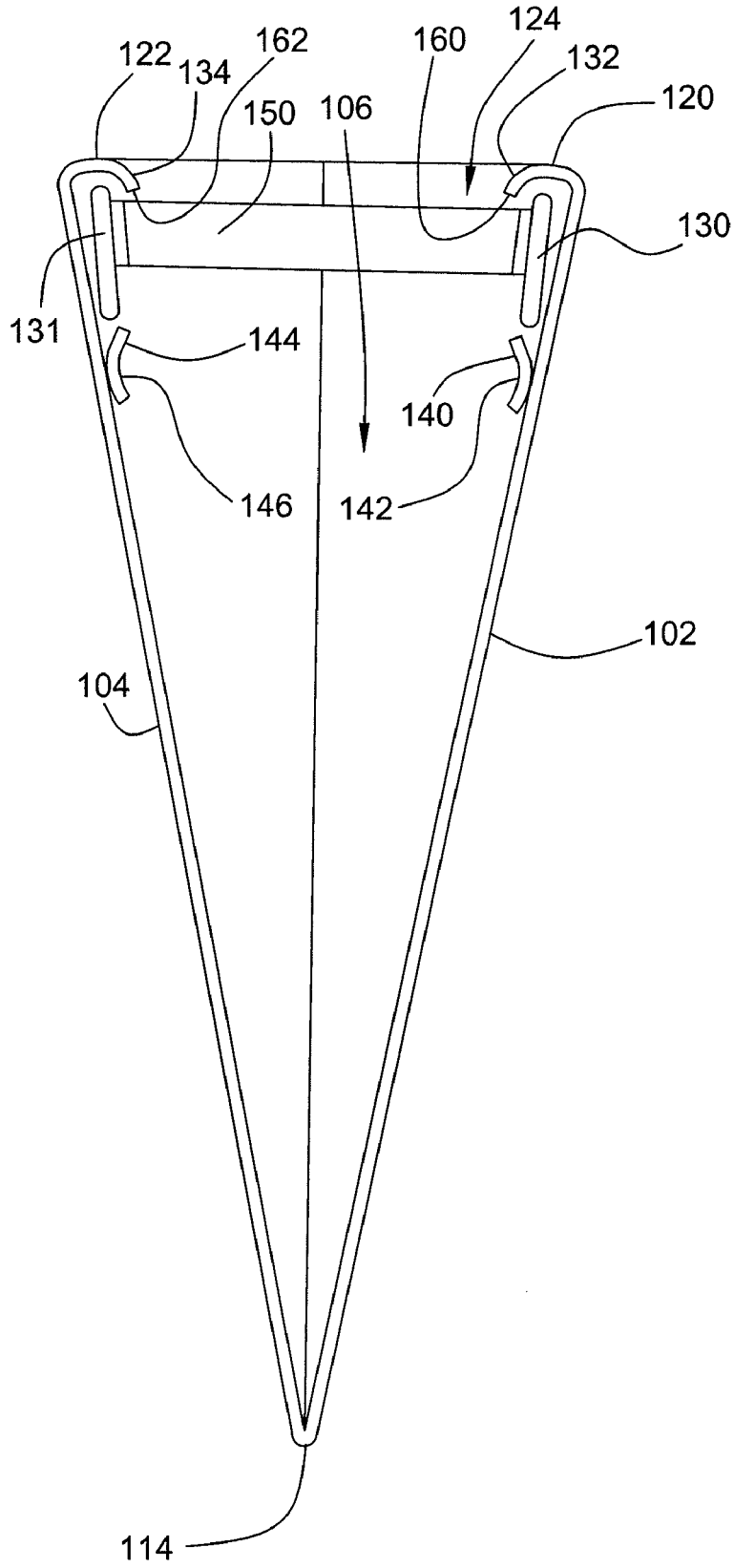
FIG. 3 is a cross-sectional view taken along line 3-3 of the bag of FIG. 1 illustrating the draw-tape accommodated in the hem.

Referring to FIGS. 1 and 3, to form the first hem 132, a hem flap 140 that is an extension of the first sidewall material is folded back into the interior volume 106 about the first top edge 120 and attached to an interior surface of the first sidewall 102 at a first hem seal 142. The folded over first hem flap 140 provides an enclosed channel or hem through which the draw tape 130 may freely extend. In another embodiment, the hem flap may be folded toward the exterior of the sidewall and may be attached to the exterior surface of the sidewall. The draw tape 130 may extend through the first hem 132 from the first side edge 110 to the second side edge 112 and may be fixedly attached to the sidewalls at the sealed together first and second side edges. The second hem 134 is likewise formed by folding a second hem flap 144 back into the interior volume and attaching the second hem flap to an interior surface of the second sidewall 104 at a second hem seal 146. A second draw tape 131 is accommodated in and extends through the channel provided by the second hem 134. To access the first and second draw tapes 130, 131, notches 148 are disposed through the first and second hems 132, 134 about mid-length along the first and second top edges 120, 122. Pulling the draw tapes through the notches 148 will constrict the top edges 120, 122 thereby drawing closed the opening 124.

To assist in securing the bag 100 to a trash receptacle or canister, the bag may include an elongated elastic strap 150 attached at attachment points associated with the first and second sidewalls 102, 104. The elastic strap 150 may be located proximate the opening 124 and may work in conjunction with the first and second top edges 120, 122 to hold the bag to the receptacle as described below. The elastic strap 150 may be made from a stretchable, elastic material that may be stretched or expanded in length and may resiliently contract back to its relaxed length. Examples of elastic materials may include rubber, polypropylene, polyethylene, isoprene, isobutylene, polyurethane (such as, spandex), and combinations thereof.

Figure 4:
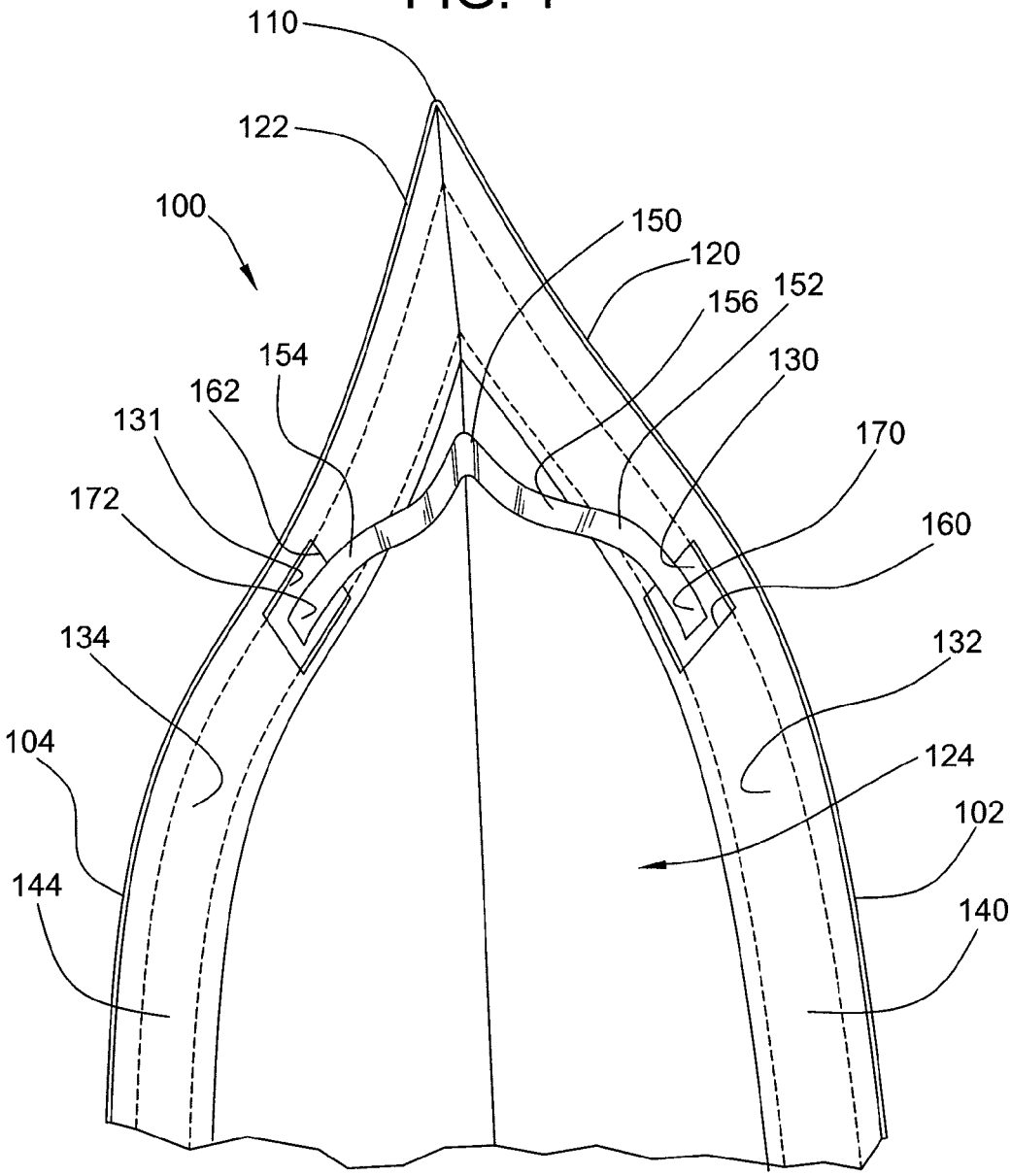
FIG. 4 is a partial top plan view of the bag of FIG. 1 illustrating the elastic strap attached to the draw-tape and extending across the opening.

Referring to FIG. 4, in the present embodiment, the elongated strap 150 may be attached by its first end 152 to the draw tape 130 accommodated in the first hem 132 and by its second end 154 to the draw tape 131 accommodated in the second hem 134. An intermediate portion 156 of the elastic strap 150 may remain loose and may extend across the opening 124. In some embodiments, the elastic strap may be exclusively attached at the first and second ends to the respective first and second sidewalls.

To attach the ends of the elastic strap 150 to the draw tapes 130, 131, as illustrated in FIGS. 1 and 4 there are disposed through the first and second hems 132, 134 a respective first aperture 160 and a second aperture 162. As illustrated, the apertures 160, 162 may be generally rectangular windows that expose the draw tape. In other embodiments, the apertures may have other shapes, such as, circular, oval, square, triangle, hexagonal, other polygons, asymmetric shapes, or other shapes. In other embodiments, the apertures 160, 162 may extend through both sides of the hem. In other embodiments, the apertures 160, 162 may be notches, such as, notches 1260, 1262 in FIGS. 29-30. In other embodiments, the aperture 160 may have a different shape than the aperture 162. The apertures may expose the draw tape without substantially destroying the channel formed by the hems 132, 134. The first end 152 of the elastic tape can be inserted into the first aperture 160 and attached to the first draw tape 130 by, for example, adhesive or heat sealing. The second end 154 of the strap 150 is inserted through the second aperture 162 and likewise attached to the second draw tape 131. The intermediate portion 156 of the elastic strap 150 passes through the apertures 160, 162 and may traverse the opening 124 between the top edges 120, 122.

The length of the elastic strap 150 when contracted or relaxed and the location of the attachment points may be selected so that the strap is normally situated between the first and second sidewalls 102, 104 within the opening 124. For example, referring to FIG. 5, the attachment point 170 associated with the first sidewall 102 may be a distance 174 from the first side edge 110 of the bag. For example, the distance 174 may have a first range from about 1 inches (2.54 cm) to about 10 inches (25.4 cm), a second range from about 3 inches (7.62 cm) to about 7.5 inches (19.05 cm), and a third range from about 4.5 inches (11.43 cm) to about 5.5 inches (13.97 cm). In one embodiment, the distance 174 may be about 5 inches (12.7 cm). The second attachment point 172 associated with the second sidewall 104 may be a distance 175 from the first side edge 110. The distance 175 may have the same dimensional information as distance 174. In one embodiment, the distance 175 may be the same as distance 174. In other embodiments, the distance 175 may be different than the distance 174.

Figure 5:
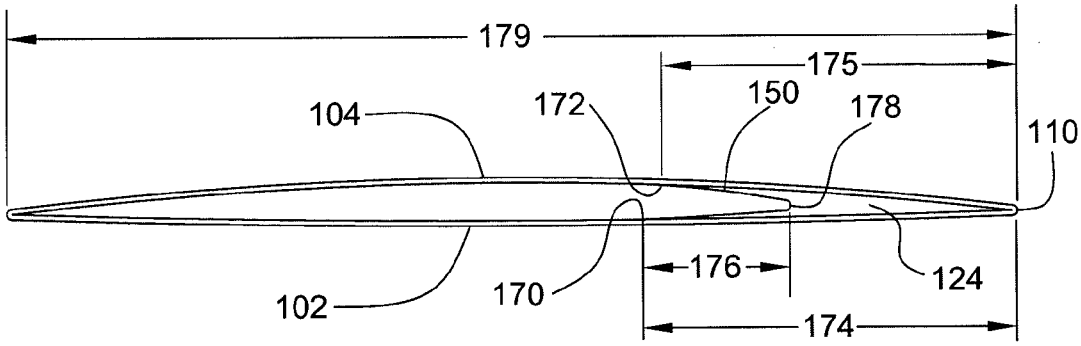
FIG. 5 is a generalized top plan view of the bag of FIG. 1 depicting lengths and dimensions of the bag opening and the attached elastic strap.

The relaxed length of the elastic strap 150 from the attachment point 170 to the attachment point 172 may be less than the sum of the distance 174 and the distance 175. In one embodiment, the strap, when relaxed, may not extend to the side edge 110, but the strap 150 may be situated within the opening 124. For example, as illustrated in FIG. 5, when the strap 150 is directed or oriented toward the first side edge 110, the strap 150 may have a relaxed distance 176 from the first attachment point 170 to an apex point 178 at which the strap folds back on itself and runs toward the second attachment point 172. The distance 176 may be less than the distance 174 and the distance 175. The distance 176 may have a first range from about 0.5 inches (1.27 cm) to about 10 inches (25.4 cm), a second range from about 0.75 inches (1.91 cm) to about 4 inches (10.16 cm), and a third range from about 1.25 inches (3.18 cm) to about 1.75 inches (4.45 cm). In one embodiment, the distance 176 may be about 1.5 inches (3.81 cm).

The bag may have a width 179. The width 179 may have a first range from about 8 inches (20.32 cm) to about 40 inches (101.6 cm), a second range from about 23 inches (58.42 cm) to about 31 inches (78.74 cm), and a third range from about 23 inches (58.42 cm) to about 25 inches (63.5 cm). In one embodiment, the width 179 may be about 24 inches (60.96 cm).

A possible advantage of configuring the relaxed length of the strap to be less than the sum of the distances between the attachment points and the side edge is that, when the bag is laid flat on one of its sidewalls, the strap is situated within the opening between the sidewalls. This may simplify packaging and distribution of the bag. Another possible advantage is that because the strap is only attached at its first and second ends and intermediate portion remains loose, the strap will not bunch or constrict the relatively inelastic sidewall material when the bag is laid flat. Hence, the bag as laid flat may have the appearance as illustrated in FIG. 2.

Figure 6:
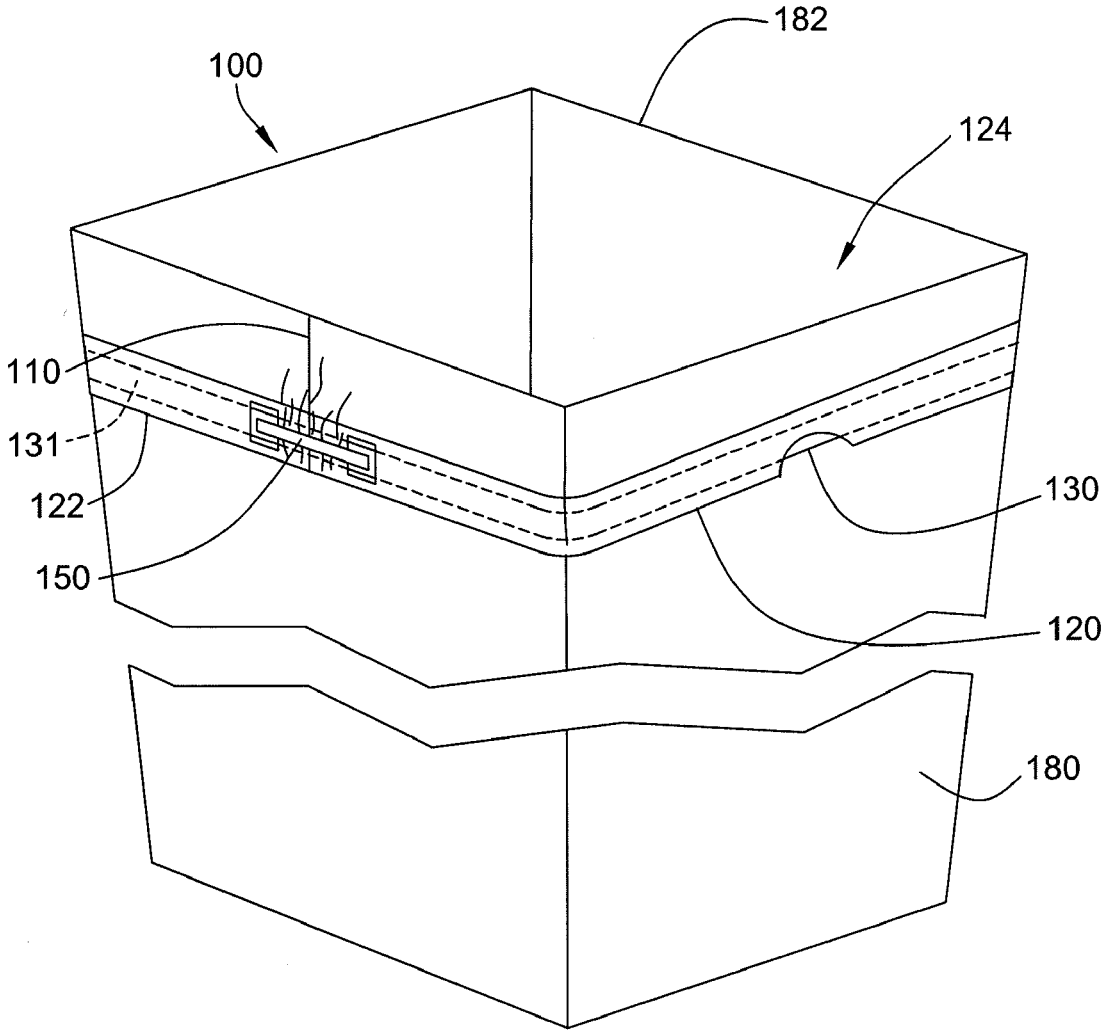
FIG. 6 is a perspective view of the bag of FIG. 1 inserted into a trash canister with the opening folded about a rim of the canister and the elastic strap securing the bag to the canister.

The elastic characteristic of the elastic strap 150, however, will allow a user to stretch the strap outward proximate to or beyond the first side edge 110. Referring to FIG. 6, this may enable the first and second top edges 120, 122 delineating the opening to be folded over or wrapped around the rim 182 of a trash receptacle 180. For example, the combined length of the first and second top edges 120, 122 may be greater than the distance about the rim 182 of the receptacle 180 so that the top edges may be folded over the rim. The bag 100 may be partially inserted into the trash receptacle 180 and the opening provided by the first and second top edges 120, 122 is turned inside out and over the rim 182. This folding and turning action stretches the elastic strap 150 to become commensurate with the side edge 110 as the strap is moved outward and over the receptacle rim 182. The tension on the elastic strap 150 is then released allowing the strap to contract and the strap pulls the draw tapes 130, 131 about the perimeter of the receptacle 180. The elastic strap may provide a gripping force for holding the bag to the receptacle and the bag may resist falling into the receptacle when large or heavy objects are placed or dropped into the bag. The location of the attachment points of the elastic strap and the degree of elasticity of the strap material may control the distance the strap may be stretched and the gripping force provided, and those factors may be adjusted or varied accordingly.

Figure 7:
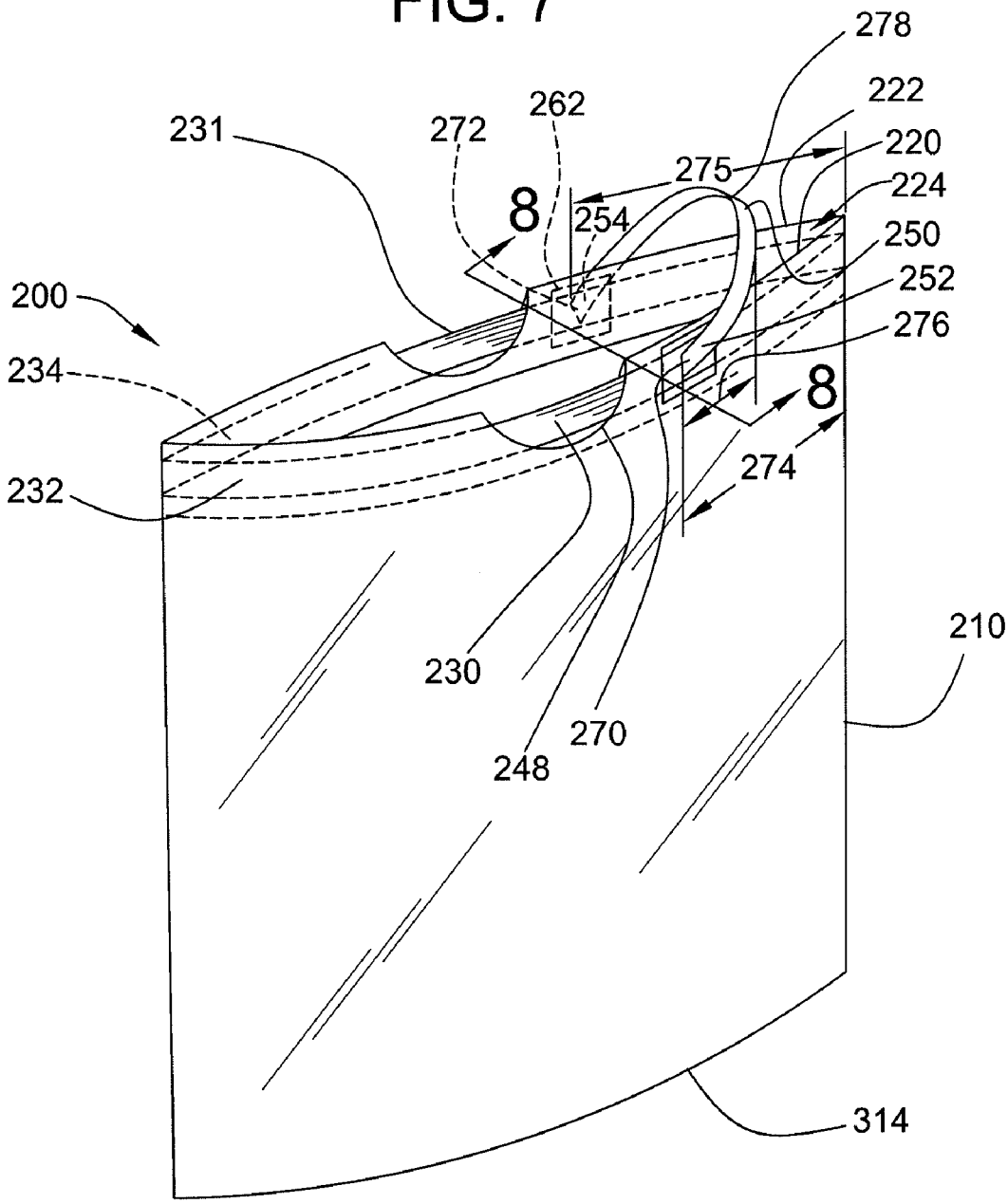
FIG. 7 is a perspective view of another embodiment a thermoplastic bag adapted for use as a trash receptacle liner which includes an elastic strap attached to a draw tape accommodated in a hem formed about the opening of the bag.
Figure 8:
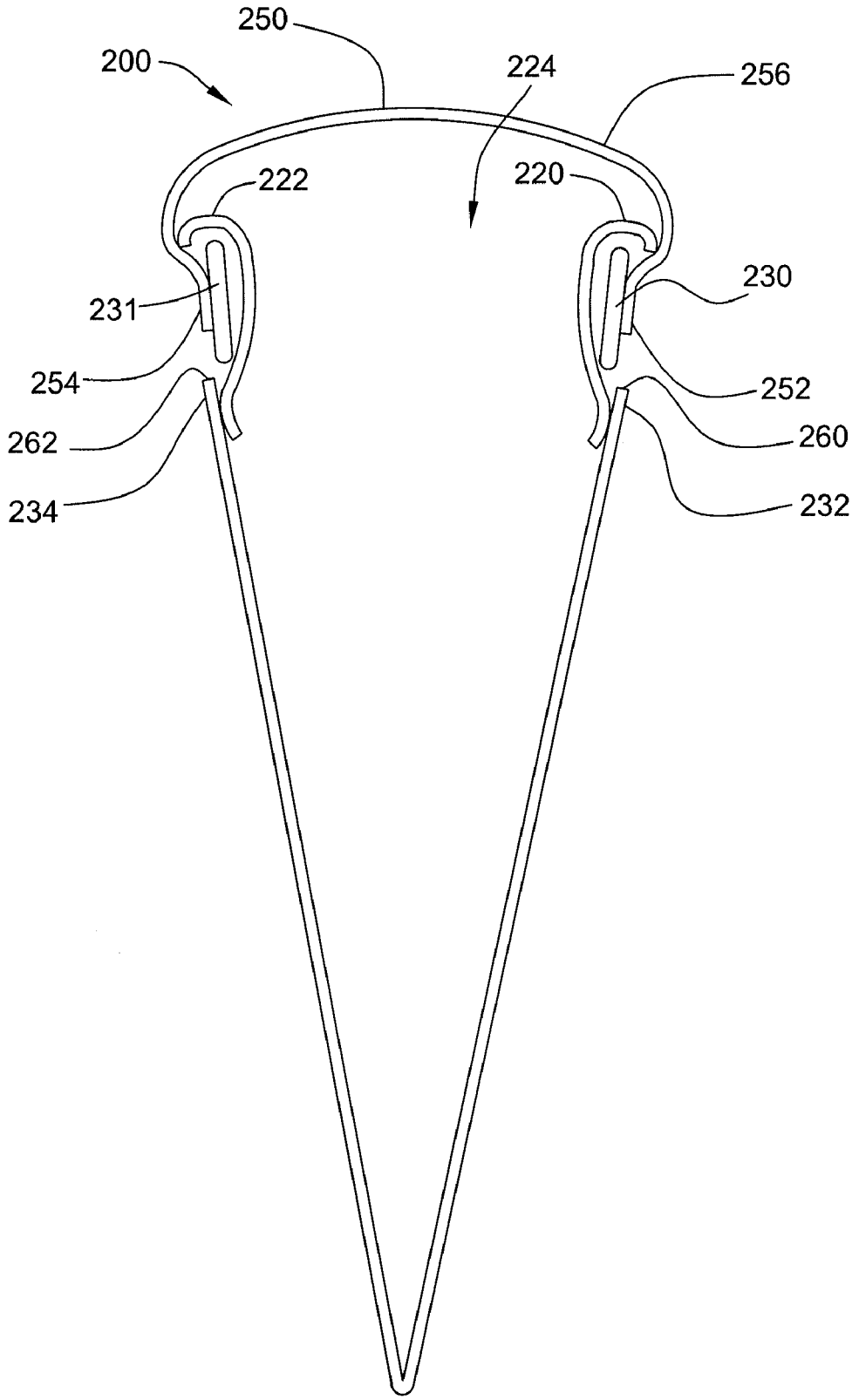
FIG. 8 is a cross-sectional view taken along line 8-8 of FIG. 7.
Figure 9:
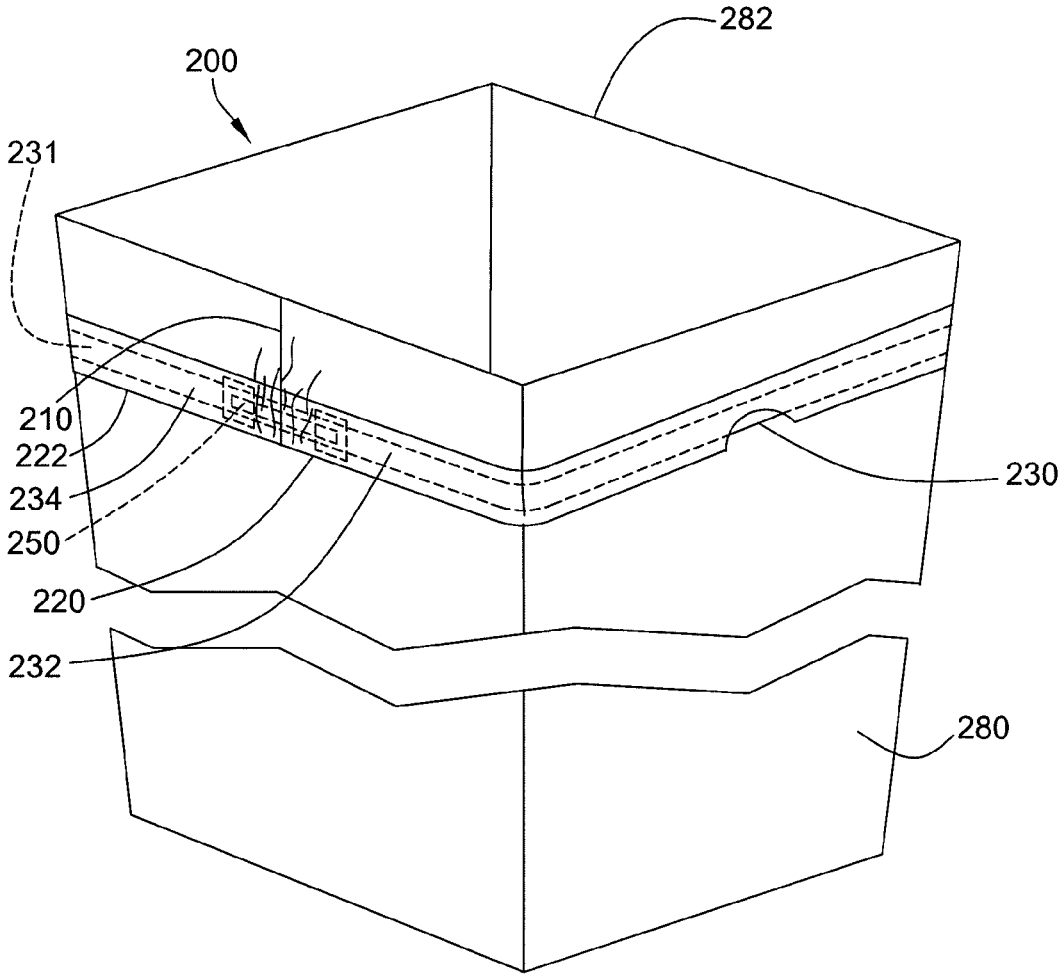
FIG. 9 is a perspective view of the bag of FIG. 7 inserted into a trash canister with the opening folded about a rim of the canister and the elastic strap securing the bag to the canister.

Referring to FIGS. 7, 8, and 9, another embodiment of a bag 200 is shown. The bag 200 may be similar to bag 100 except that the strap 250 may be attached to the draw tapes 230, 231 through apertures 260, 262 in the outside portion of the hems 232, 234. The intermediate portion 256 of the strap 250 may run over and about the first and second edges 220, 222 to traverse the opening 224. Referring to FIG. 7, the total length of the elastic strap 250 between the first and second attachment points 270, 272 may be less than the sum of the distance 274 between the first attachment point 270 of the first end 252 and the first side edge 210 and the distance 275 between the second attachment point 272 of the second end 254 and the first side edge 210. Accordingly, the elastic strap when relaxed may not extend to the first side edge 210 of the bag.

Referring to FIG. 7, the strap 250 may have a distance 276 from the first attachment point 270 to an apex point 278. The distance 274 may have the same dimensional information as distance 174. The distance 275 may have the same dimensional information as distance 175. The distance 276 may have the same dimensional information as distance 176.

The elastic characteristic of the elastic strap 250, however, will allow a user to stretch the strap outward proximate to or beyond the first side edge 210. Referring to FIG. 9, this may enable the first and second top edges 220, 222 delineating the opening to be folded over or wrapped around the rim 282 of a trash receptacle 280. For example, the combined length of the first and second top edges 220, 222 may be greater than the distance about the rim 282 of the receptacle 280 so that the top edges may be folded over the rim. The bag 200 may be partially inserted into the trash receptacle 280 and the opening provided by the first and second top edges 220, 222 is turned inside out and over the rim 282. This folding and turning action stretches the elastic strap 250 to become commensurate with the side edge 210 as the strap is moved outward and over the receptacle rim 282. The tension on the elastic strap 250 is then released allowing the strap to contract and the strap pulls the draw tapes 230, 231 about the perimeter of the receptacle 280. The elastic strap may provide a gripping force for holding the bag to the receptacle and the bag may resist falling into the receptacle when large or heavy objects are placed or dropped into the bag.

Figure 10:
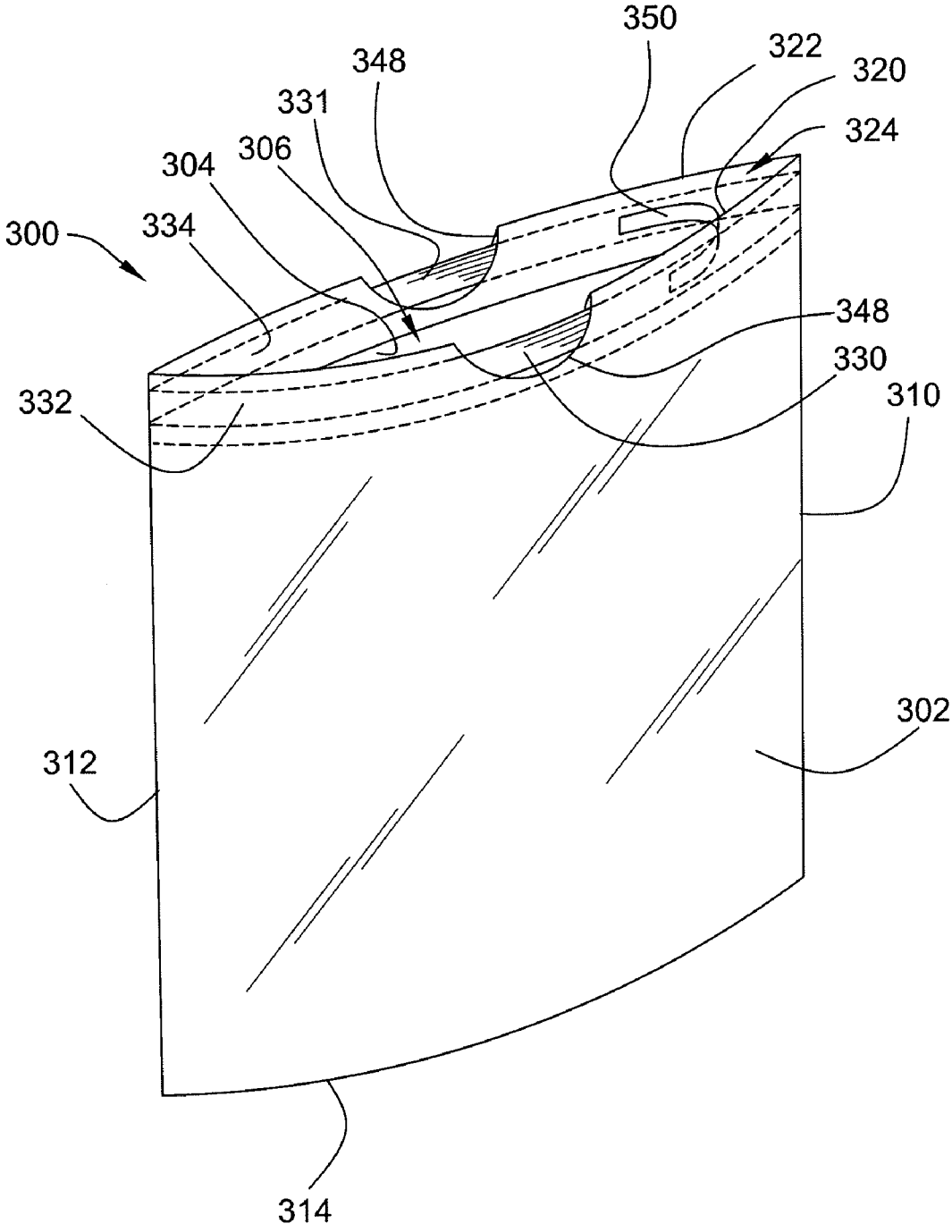
FIG. 10 is a perspective view of another embodiment of a thermoplastic bag adapted for use as a trash receptacle liner including an elastic strap attached to an inner surface of a hem accommodating a draw tape.
Figure 11:
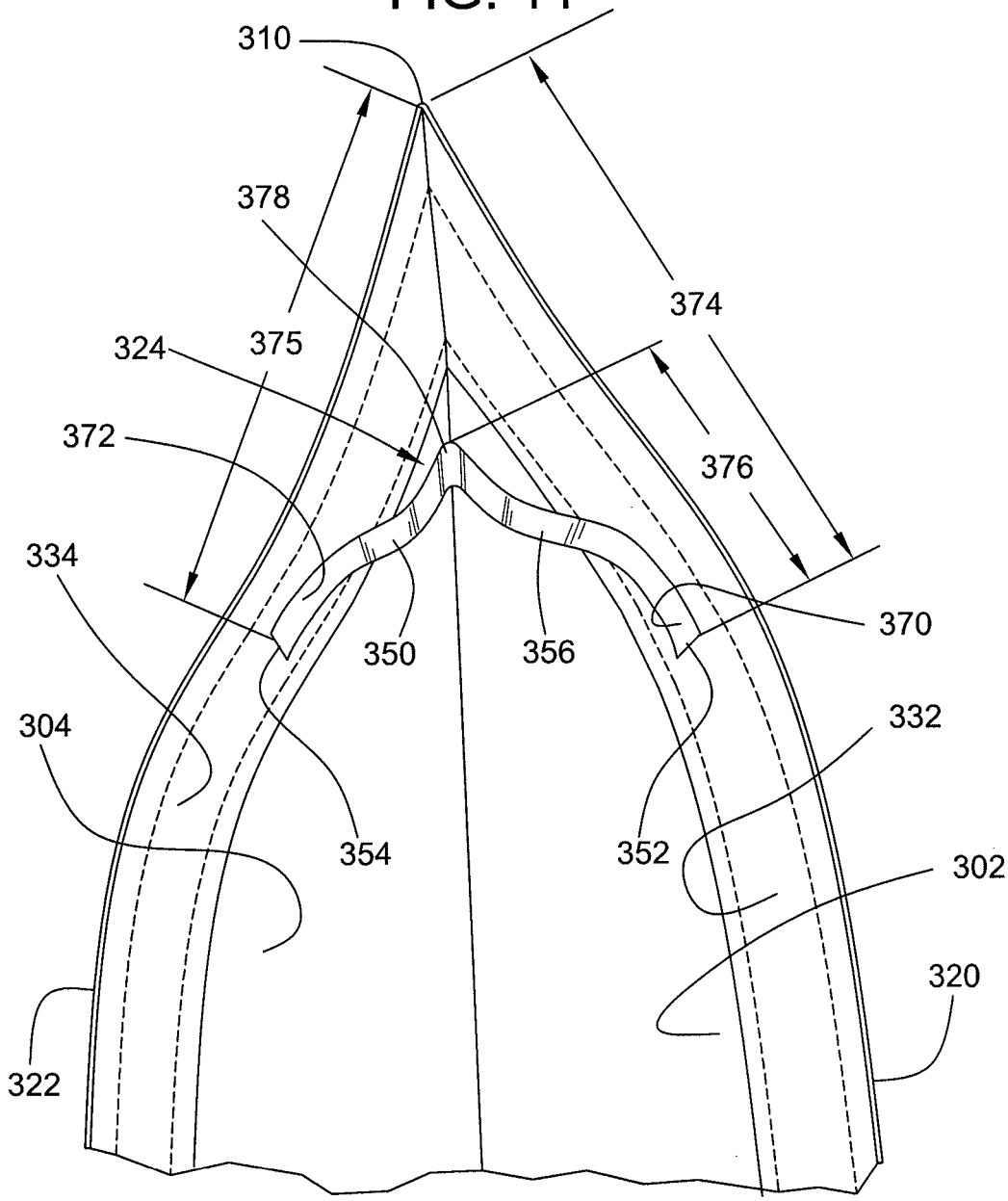
FIG. 11 is a partial top plan view of the bag of FIG. 10 illustrating the elastic strap attached to the inner surface of the hem and extending across the opening.

In other embodiments of the bag, the elastic strap does not need to be attached to the draw tape to function in the foregoing manner. For example, referring to FIGS. 10, 11 and 12, there is illustrated another embodiment of a thermoplastic bag 300 intended for use as a trash receptacle liner that is equipped with an elastic strap 350. Referring to FIGS. 10 and 11, the thermoplastic bag 300 may have a first sidewall 302 and a second sidewall 304 of pliable thermoplastic material that are overlaid and joined to each other to provide an interior volume 306. The first and second sidewalls 302, 304 may be rectangular in shape and may be joined along a first side edge 310, a second side edge 312, and a bottom edge 314. The first and second side edges may be joined by, for example, heat sealing. To access the interior volume 306, the first and second top edges 320, 322 of the respective sidewalls 302, 304 may remain un-joined to delineate an opening 324. To close the opening 324, first and second draw tapes 330, 331 may be positioned in respective first and second hems 332, 334 formed along the first and second top edges 320, 322. The draw tapes 330, 331 may be drawn or pulled through notches 348 disposed through the hems 332, 334 to constrict the opening 324.

The elastic strap 350 may be provided as an elongated strip or length of elastic material that enables the strap to stretch and contract. Referring to FIG. 11, the strap 350 may be attached at a first end 352 to an attachment point 370 associated with the first sidewall 302 and at its second end 354 to a second attachment point 372 associated with a second sidewall 304. In the present embodiment, the first end 352 is attached to the inwardly folded hem flap that provides the first hem 332 and the second end 354 attaches to the inwardly folded hem flap of the second hem 334. The intermediate length 356 of the elastic strap 350 traverses the opening 324 between the first and second top edges 320, 322.

The length of the elastic strap 350 and the location of the attachment points may be selected so that the strap normally is situated within the bag opening 324 between the first and second top edges 320, 322. For example, the first attachment point 370 may be a distance 374 from the first side edge 310. The second attachment point 372 may be a distance 375 from the first side edge 310. The elastic strap 350 may have a distance 376 from the first attachment point 370 to an apex point 378 at which the strap folds back and is directed toward the second attachment point 372. The distance 376 may be less than the distance 374 and the distance 375 so that the strap does not extend to the first side edge 310. The relaxed length of the strap 350 from the attachment point 370 to the attachment point 372 may be less than the sum of the distance 374 and the distance 375. The distance 374 may have the same dimensional information as distance 174. The distance 375 may have the same dimensional information as distance 175. The distance 376 may have the same dimensional information as distance 176.

Figure 12:
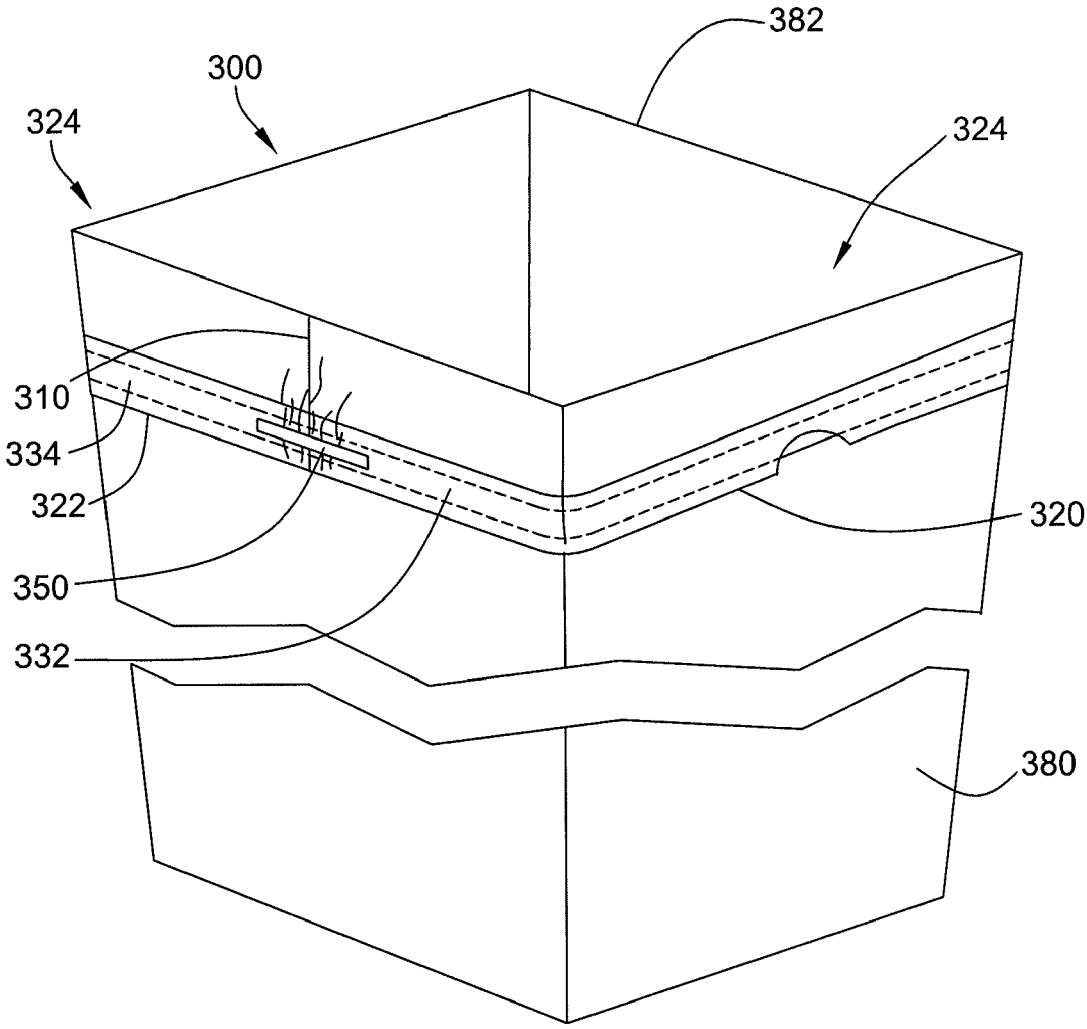
FIG. 12 is a perspective view of the bag of FIG. 10 inserted into a trash canister with the opening folded about a rim of the canister and the elastic strap securing the bag to the canister.

The elastic characteristic enables the elastic strap to stretch outwardly proximate to or beyond the first side edge to facilitate inserting and securing the bag to a trash receptacle. Referring to FIG. 12, when the bag 300 is inserted into the receptacle 380 and the first and second top edges 320, 322 are folded over the receptacle rim 382, the elastic strap 350 stretches to become commensurate with the first side edge 310 of the bag. The tension on the elastic strap is then released causing the strap 350 to recover or contract while pulling the first and second hems 332, 334 about the perimeter of the receptacle 380. This elastic pulling force secures or holds the bag to the receptacle.

Figure 13:
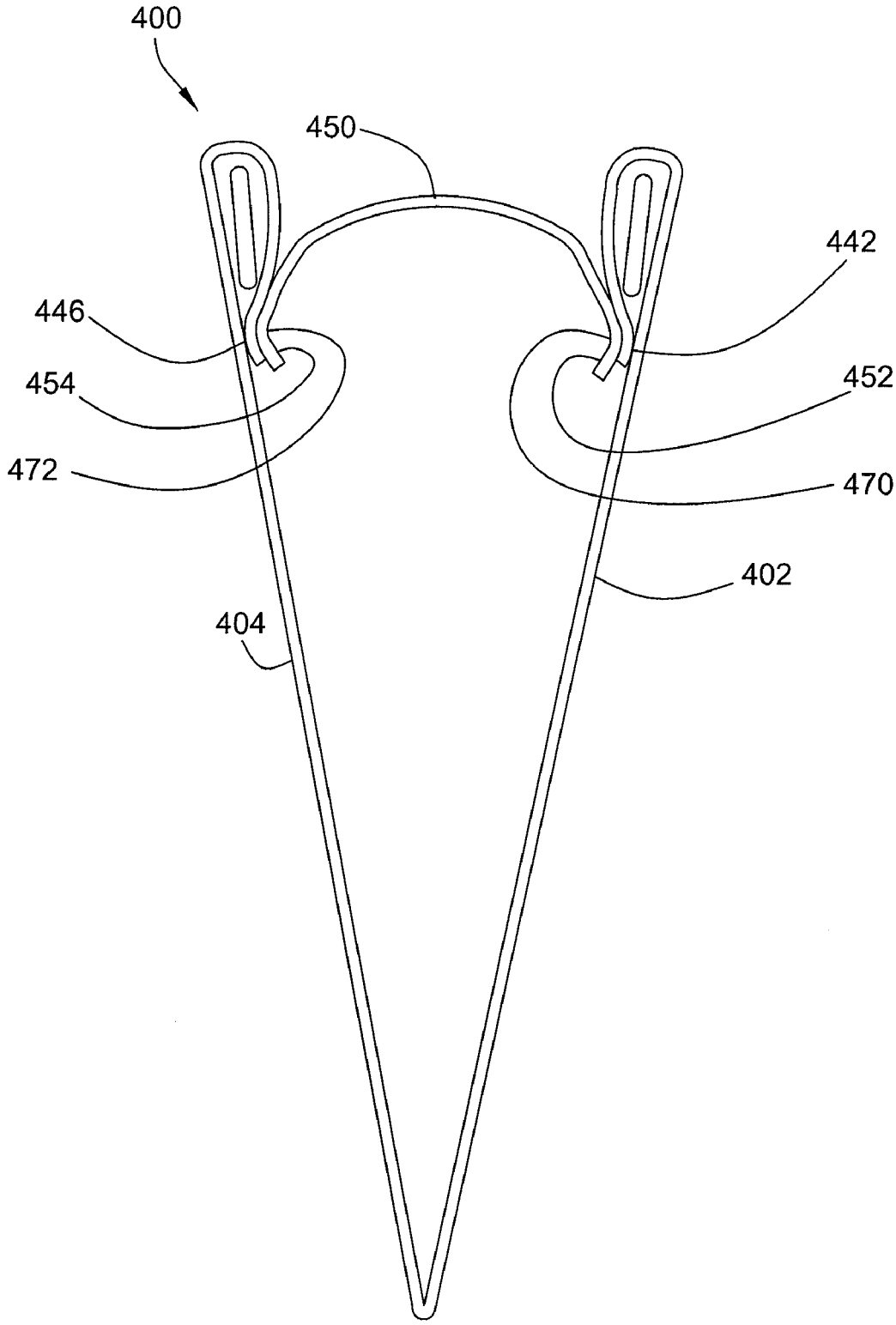
FIG. 13 is a cross-sectional view of another embodiment.

In another embodiment, the attachment points may be at the hem seals. Referring to FIG. 13, the bag 400 may be similar to bag 300 except that the first attachment point 470 of the first strap end 452 of the strap 450 may be at the hem seal 442 on the first sidewall 402 and the second attachment point 472 of the second strap end 454 may be at the hem seal 446 on the second sidewall 404.

In other embodiments, the elastic strap can be attached to the bag so as to be situated outside the interior volume. For example, referring to FIGS. 14, and 15, a thermoplastic bag 500 may include first and second thermoplastic sidewalls 502, 504 overlaid and joined to one another to provide an interior volume 506. The sidewalls 502, 504 may be joined along a first side edge 510, a second side edge 512, and a bottom edge 514. The interior volume 506 may be accessible via an opening 524 delineated by un-joined first and second top edges 520, 522 of the respective first and second sidewalls 502, 504. To close the opening 524, the bag 500 may include first and second draw tapes 530, 531 positioned in respective first and second hems 532, 534 formed along the first and second top edges 520, 522. The draw tapes 530, 531 may be drawn or pulled through notches 548 disposed through the hems 532, 534 to close the opening 524.

Figure 14:
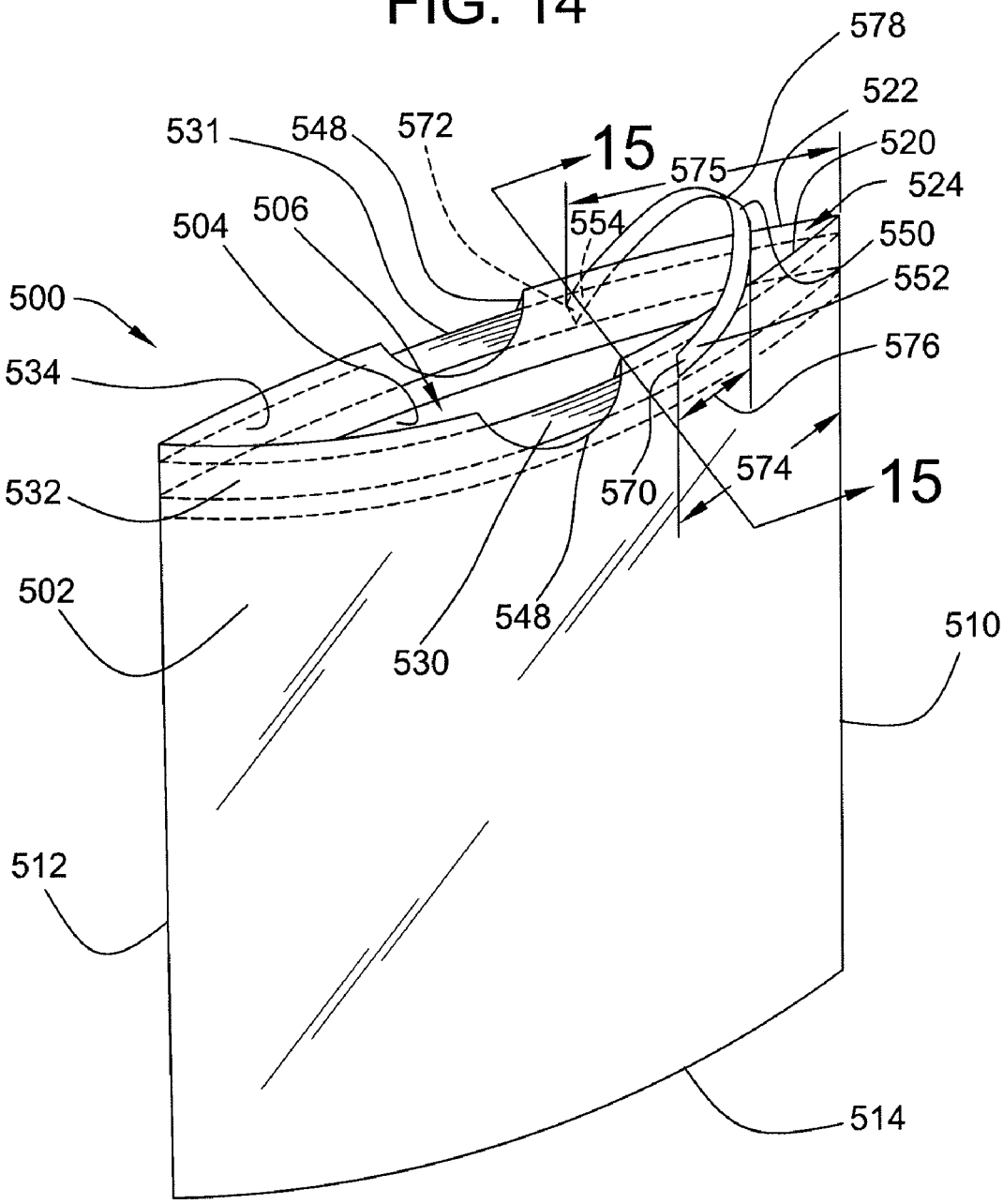
FIG. 14 is a perspective view of another embodiment of a thermoplastic bag adapted for use as a receptacle for a trash canister liner including an elastic strap attached to an outer surface of a hem accommodating a draw tape.
Figure 15:
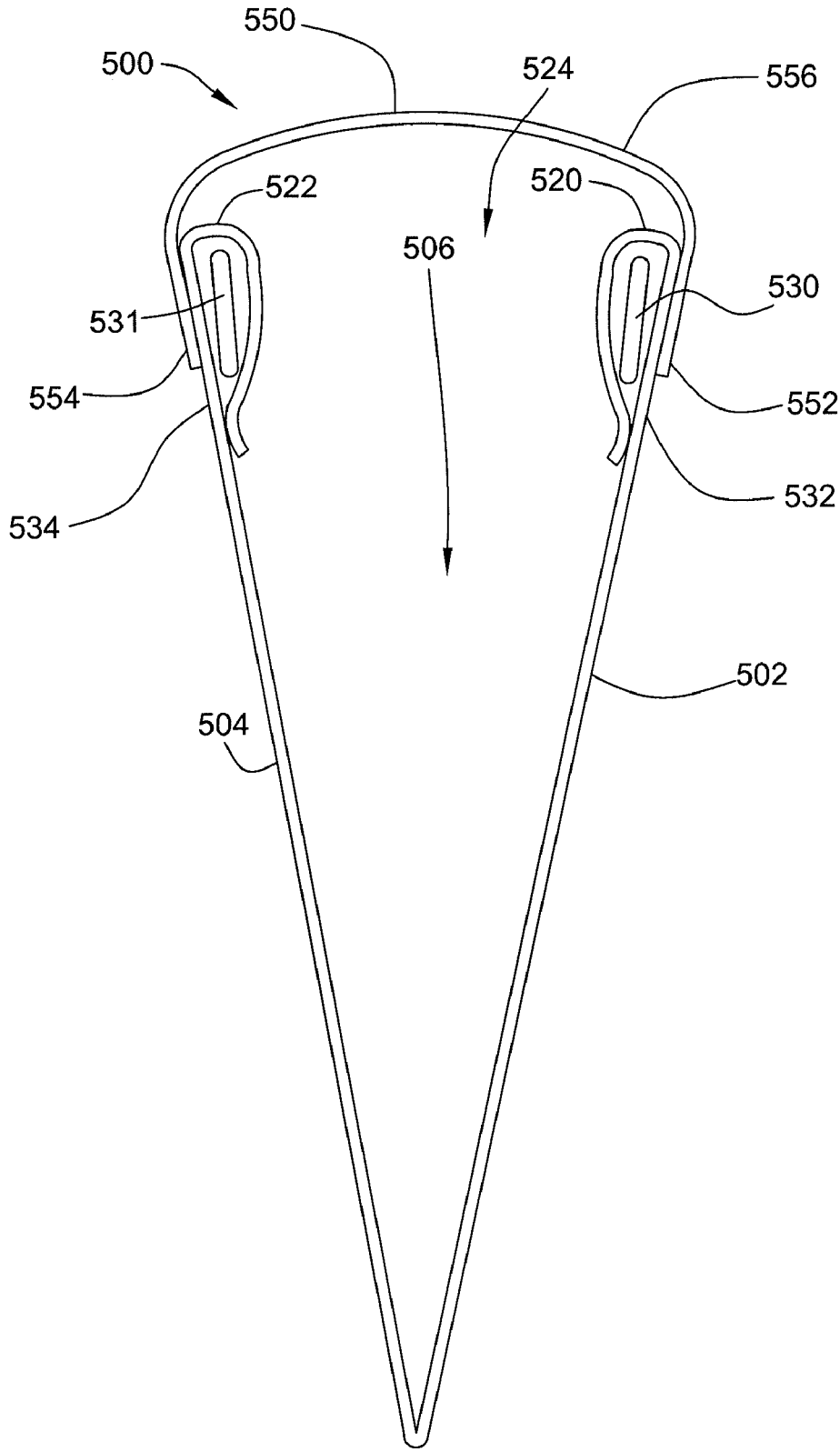
FIG. 15 is a cross-sectional view taken along line 15-15 of FIG. 14 illustrating the draw tape accommodated in the hem and the elastic strap extending across the hem.

The elastic strap 550 may be length or strip of elastic material that may stretch and contract. The elastic strap 550 may be attached by a first end 552 to the exterior of the first sidewall 502 at the first hem 532 and at a second end 554 to the exterior of the second sidewall 504 at the second hem 534. The intermediate portion 556 of the elastic strap 550 runs over and about the first and second top edges 520, 522 to traverse the opening 524. Referring to FIG. 14, the total length of the elastic strap 550 between the first and second attachment points 570, 572 may be less than the sum of the distance 574 between the first attachment point 570 of the first end 552 and the first side edge 510 and the distance 575 between the second attachment point 572 of the second end 554 and the first side edge 510. Accordingly, the elastic strap when relaxed may not extend to the first side edge 510 of the bag.

Referring to FIG. 14, the strap 550 may have a distance 576 from the first attachment point 570 to an apex point 578. The distance 574 may have the same dimensional information as distance 174. The distance 575 may have the same dimensional information as distance 175. The distance 576 may have the same dimensional information as distance 176.

Figure 16:
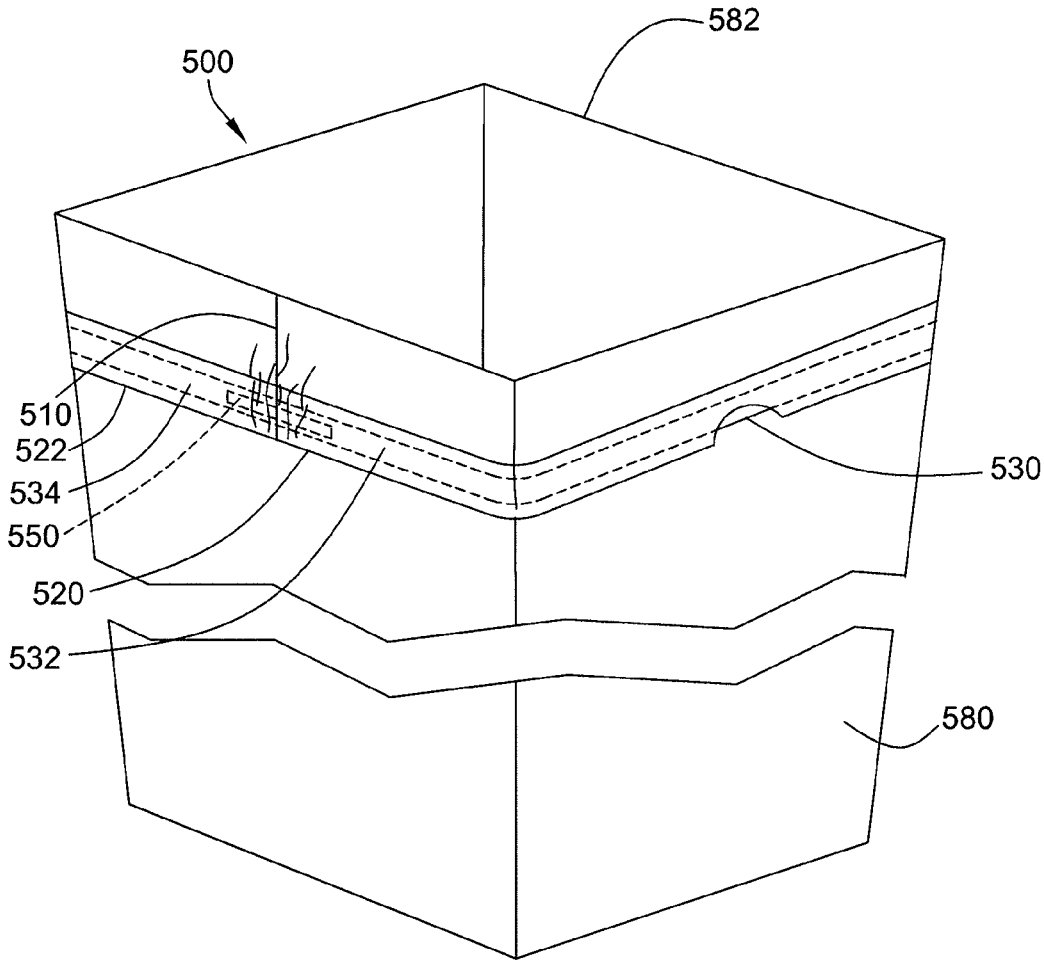
FIG. 16 is a perspective view of the bag of FIG. 14 inserted into a trash canister with the opening folded about the rim of the canister and the elastic strap securing the bag to the canister.

Referring to FIG. 16, the elastic characteristic allows a user to stretch the elastic strap 550 to and beyond the first side edge 510 when installing the bag 500 in a trash receptacle 580. As illustrated, the elastic strap 550 stretches when the first and second top edges 520, 522 are folded over the receptacle rim 582. The strap 550 may then contract and may pull the hems 532, 534 about the perimeter of the receptacle 580 and may secure the bag to the receptacle. Because the elastic strap 550 is attached to the exterior of the bag 500, the strap may be located between the folded-over sidewall and the receptacle 580.

Figure 17:
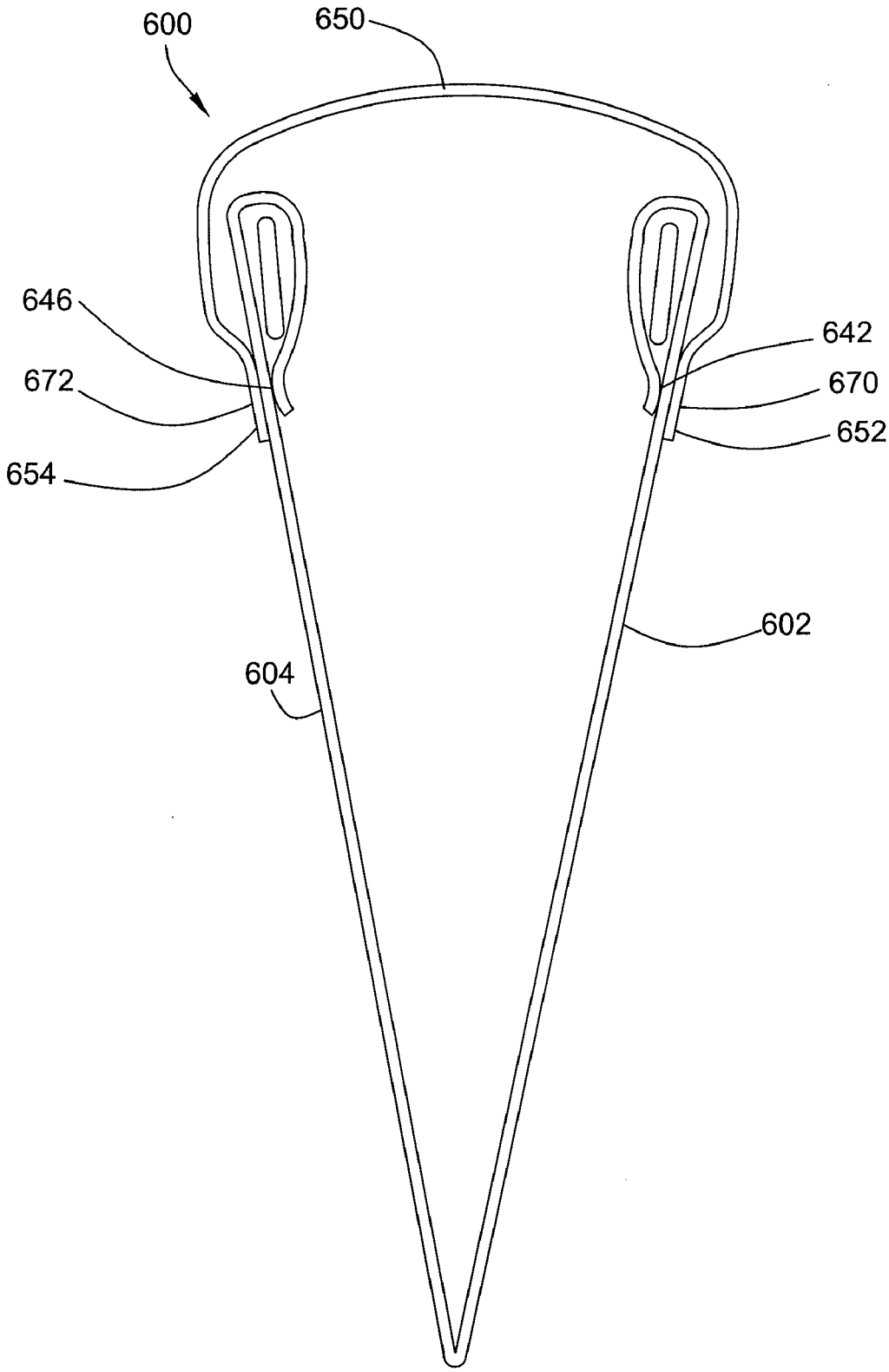
FIG. 17 is a cross-sectional view of another embodiment.

In another embodiment, the attachment points may be at the hem seal. Referring to FIG. 17, the bag 600 may be similar to bag 500 except that the first attachment point 670 of the first strap end 652 of the strap 650 may be at the hem seal 642 on the first sidewall 602 and the second attachment point 672 of the second strap end 654 may be the hem seal 646 on the second sidewall 604.

Figure 18:
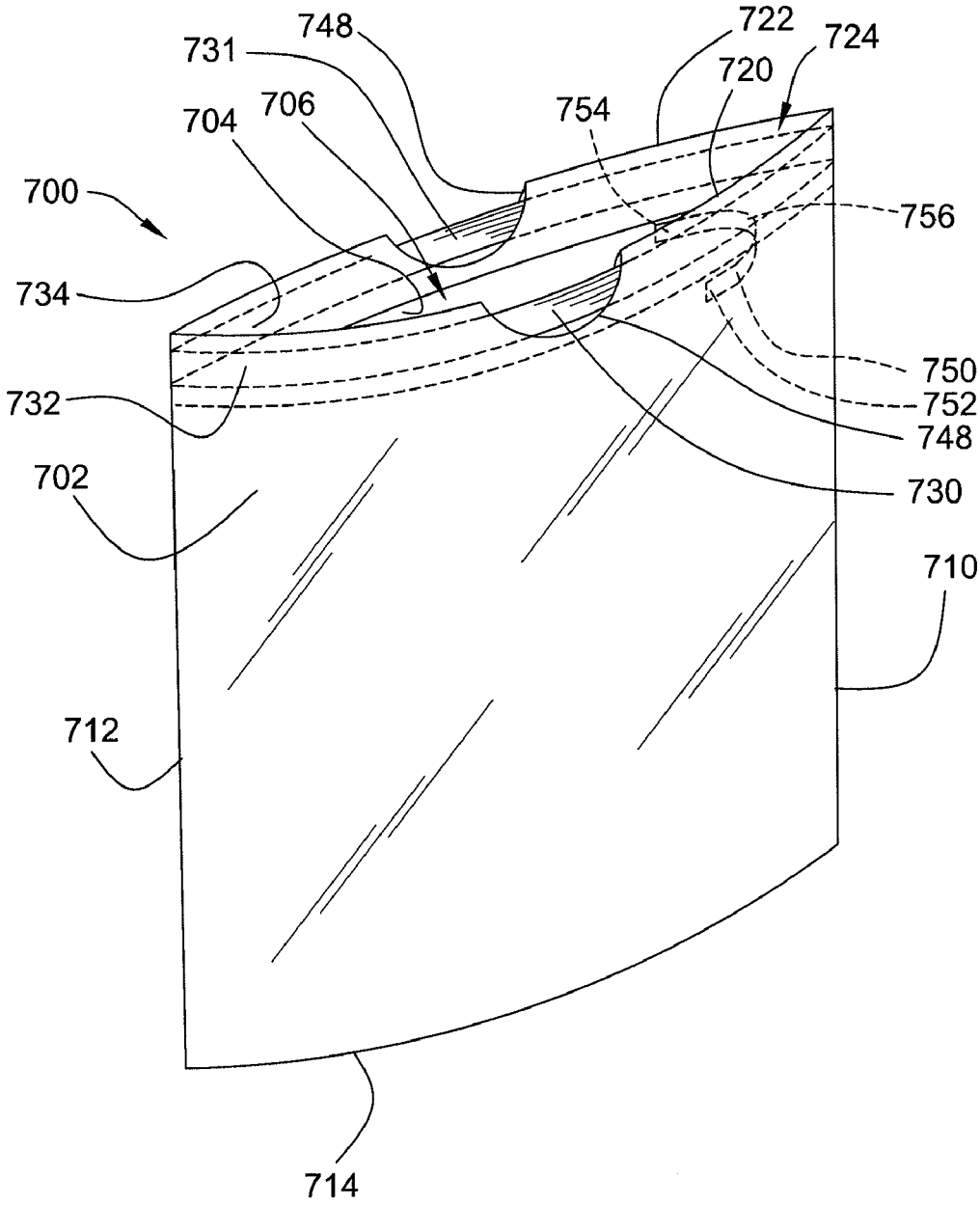
FIG. 18 is a perspective view of another embodiment of a thermoplastic bag adapted for use as a liner for a trash canister including an elastic strap attached to an inner surface of the bag sidewalls below a hem accommodating a draw tape.
Figure 19:
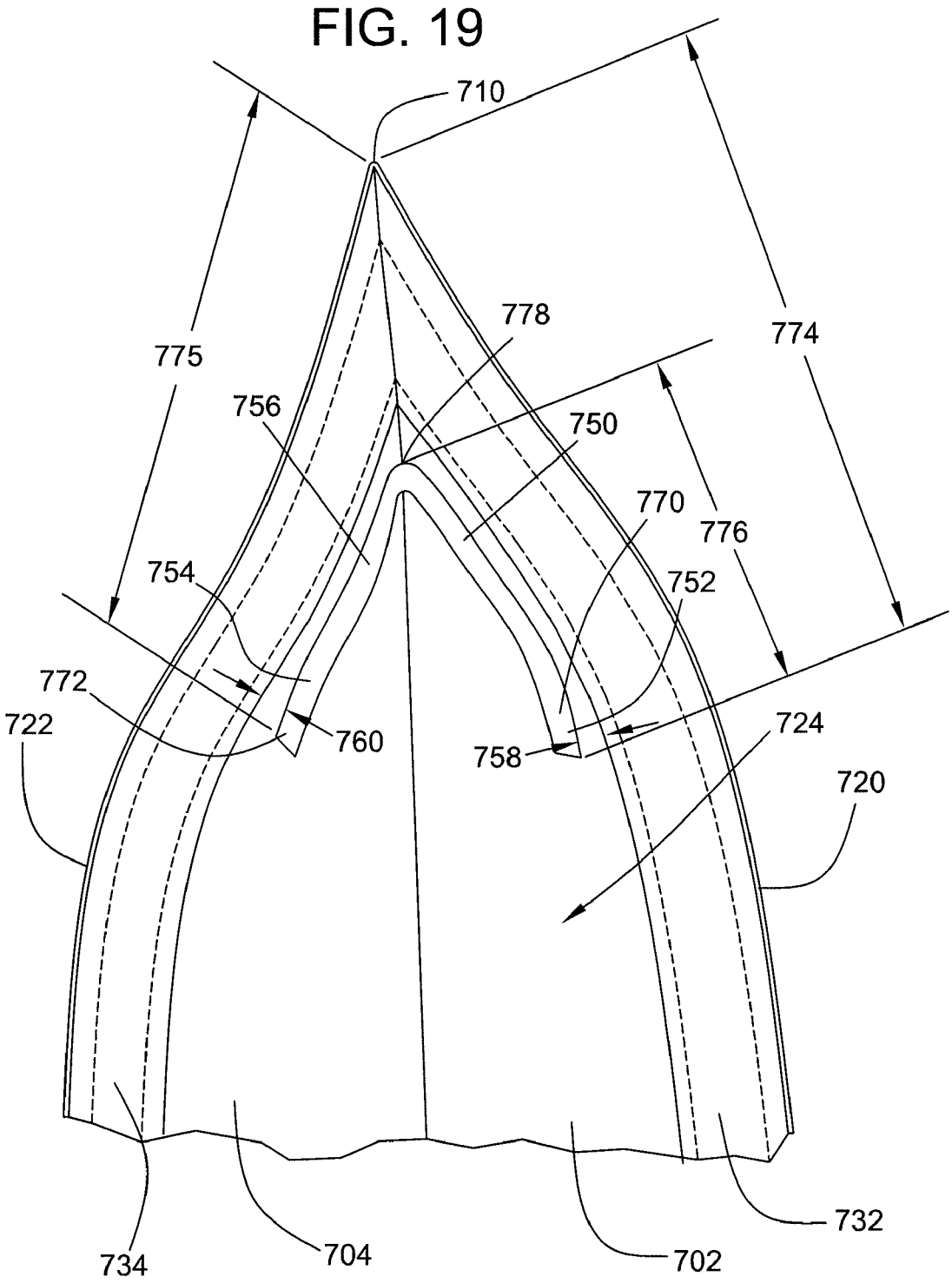
FIG. 19 is a partial top plan view of the bag of FIG. 18 illustrating the elastic strap attached to the inner surface of the bag sidewalls and extending across the opening.

Referring to FIGS. 18 and 19, there is illustrated another embodiment of a thermoplastic bag 700 intended for use as a trash receptacle liner. The bag may include overlapping first and second sidewalls 702, 704 that may be joined together along first and second side edges 710, 712 and a bottom edge 714 to provide an interior volume 706. The interior volume 706 may be accessible via an opening 724 provided by the un-joined first and second top edges 720, 722 of the respective side walls. To close the opening, a draw tape 730 may be positioned in a hem 732 formed along the top edge 720 of the first sidewall 702 and a second draw tape 731 may be positioned in a second hem 734 formed along the top edge 722 of the second sidewall 704. The draw tapes 730, 731 may be drawn through notches 748 disposed through the first and second hems 732, 734.

The elastic strap 750 may be an elongated strip of elastic material that may be attached at a first end 752 to a first attachment point associated with the first sidewall 702 and at a second end 754 to a second attachment point associated with the second sidewall 704 such that an intermediate portion 756 extends across the opening 724. In the present embodiment, the attachment points are located below the first and second hems 732, 734. For example, the first end 752 of the strap 750 is attached to an inner surface of the first sidewall 702 below where the flap of the first hem 732 seals to the inner surface. The second end 754 is attached below the second hem 734 on the opposite second sidewall 704. The elastic strap is situated within the opening 724. The relaxed length of the strap and location of the attachment points may be selected so that the strap does not extend all the way to the first side edge 710. The distance 774 may have the same dimensional information as distance 174. The distance 775 may have the same dimensional information as distance 175. The distance 776 may have the same dimensional information as distance 176.

Referring to FIG. 19, the first attachment point of the first strap end 752 may be located a distance 758 below the hem 732. The distance 758 may have a first range from about 0 inches (0 cm) to about 30 inches (76.2 cm), a second range from about 0 inches (0 cm) to about 1 inch (2.54 cm), and a third range from about 0.25 inches (0.64 cm) to about 0.75 inches (1.91 cm). In one embodiment, the distance 758 may be about 0.5 inches (1.27 cm). The second attachment point of the second end 754 may be located a distance 760 below the second hem 734. The distance 760 may have the same dimensional information as distance 758. The distance 758 may be the same as distance 760. In other embodiments, the distance 758 may be different than the distance 760.

Referring to FIG. 19, the first attachment point 770 may be a distance 774 from the first side edge 710. The second attachment point 772 may be a distance 775 from the first side edge 710. The strap 750 may have a distance 776 from the first attachment point 770 to an apex point 778. The relaxed length of the strap 750 from the attachment point 770 to the attachment point 772 may be less than the sum of the distance 774 and the distance 775. The distance 774 may have the same dimensional information as distance 174. The distance 775 may have the same dimensional information as distance 175. The distance 776 may have the same dimensional information as distance 176.

Figure 20:
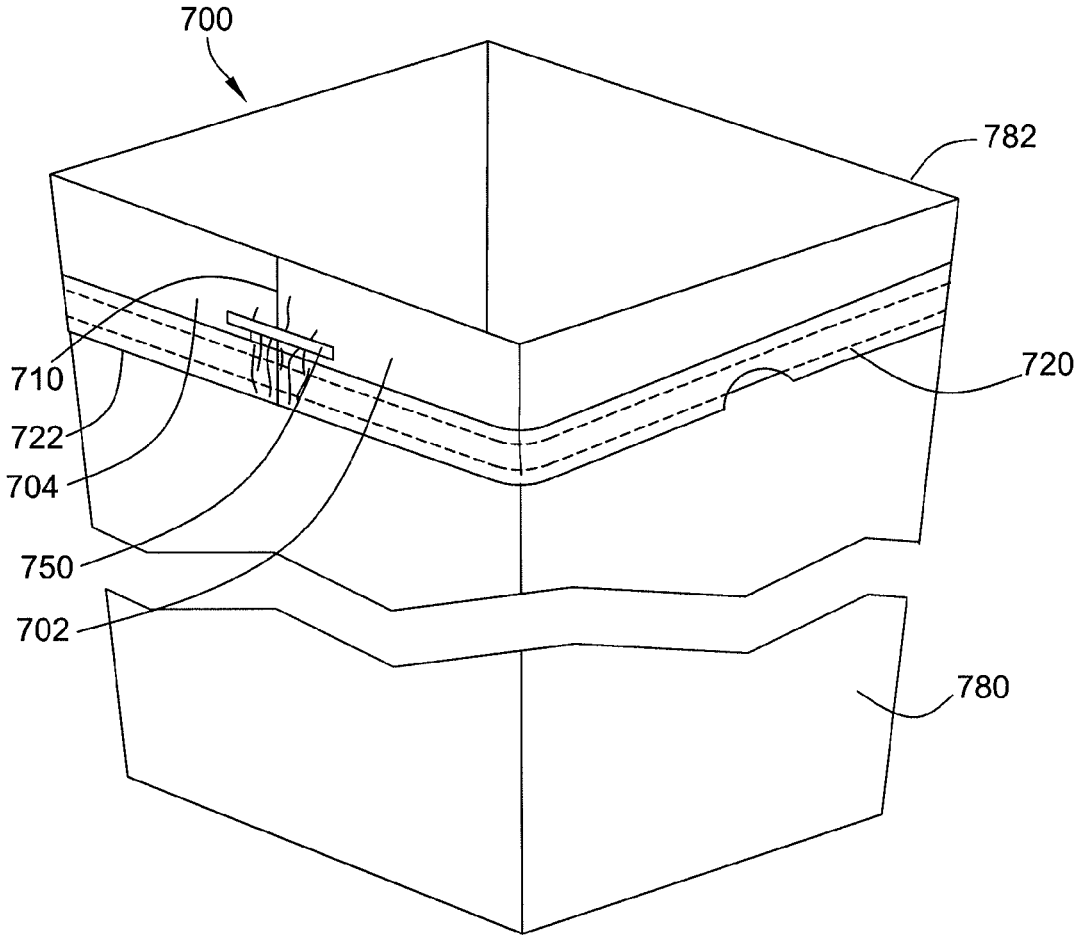
FIG. 20 is a perspective view of the bag of FIG. 18 inserted into a trash canister with the opening folded about a rim of the canister and the elastic strap securing the bag to the canister.

Referring to FIG. 20, the elastic characteristic allows the strap to stretch and contract when installing the bag 700 as a liner in a trash receptacle 780. Specifically, when the first and second top edges 720, 722 are folded over the rim 782, the elastic strap 750 may stretch outward to be commensurate with the first side edge 710. The elastic strap 750 may then partially recover or contract to pull the sidewalls 702, 704 about the perimeter of the trash receptacle 780. This may help hold the bag to the receptacle and may prevent the bag from falling into the receptacle.

Figure 21:
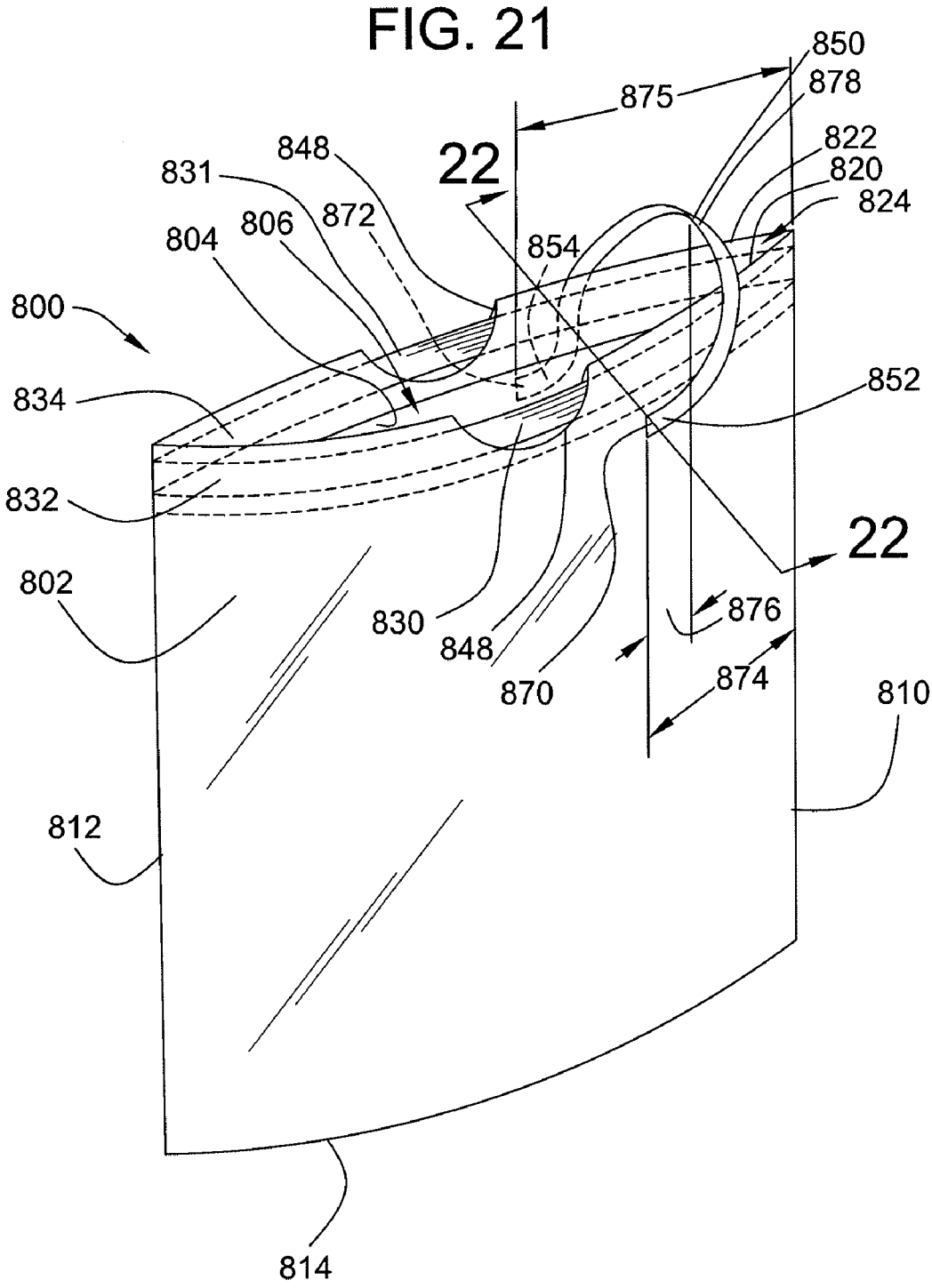
FIG. 21 is a perspective view of another embodiment of a thermoplastic bag adapted for use as a trash canister liner including an elastic strap attached to the outer surface of the bag sidewall below a hem accommodating a draw tape.
Figure 22:
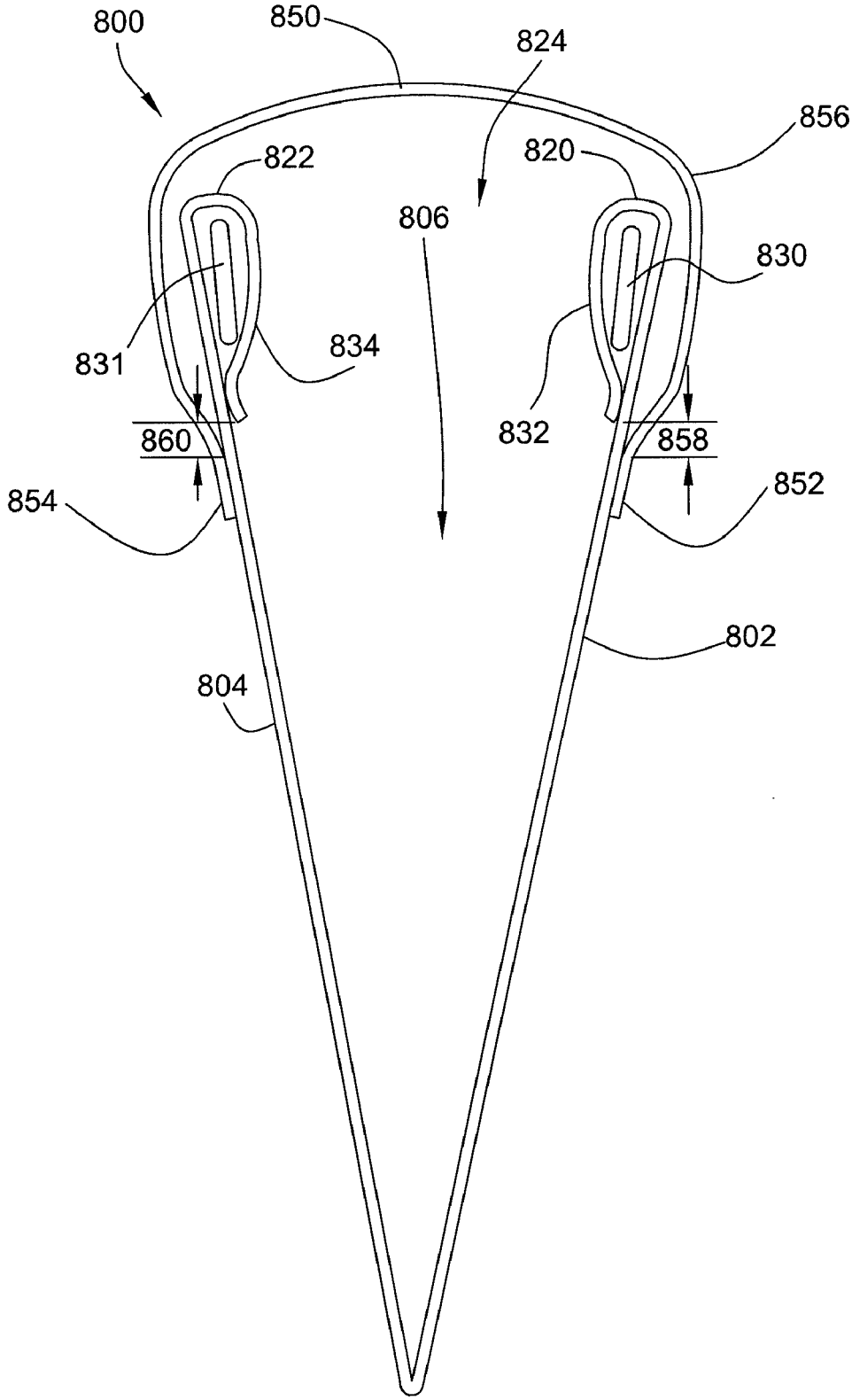
FIG. 22 is a cross-sectional view taken along line 22-22 of FIG. 21 illustrating the draw tape accommodated in the hem and the elastic strap extending across the bag opening.

Referring to FIGS. 21 and 22, there is illustrated another embodiment of a thermoplastic bag 800 intended for use as a trash receptacle liner with an elastic strap for securing the bag to the receptacle. The bag 800 may include first and second sidewalls 802, 804 that may be overlaid and joined to each other along a first side edge 810, a second side edge 812 and a bottom edge 814 to provide an interior volume 806. The top edges 820, 822 of the respective first and second sidewalls may remain un-joined to provide an opening 824 through which the interior volume 806 may be accessed. To close the opening, a draw tape 830 may be positioned in a first hem 832 formed along the top edge 820 of the first sidewall 802 and a second draw tape 831 may be positioned in a second hem 834 formed along the top edge 822 of the second sidewall 804. The draw tapes 830, 831 may be drawn through notches 848 disposed through the first and second hems 832, 834.

The elastic strap 850 may be formed as an elongated strip of elastic material that may be attached by a first end 852 to a first attachment point associated with the first side wall and at second end 854 to a second attachment point associated with the second sidewall. In the illustrated embodiment, the first and second ends 852, 854 are attached to the exterior of the sidewalls 802, 804 generally below the first and second hems 832, 834. The intermediate portion 856 of the strap extends over and around the first and second top edges 820, 822 to cross over the opening 824. As described above, the relaxed length of the elastic strap and the distance between the attachment points and the sidewall may be selected so that the strap does not normally extend to the side edge 810.

Referring to FIG. 22, the attachment points of the first end 852 may be a distance 858 below the hem 832. The distance 858 may have a first range from about 0 inches (0 cm) to about 5 inches (12.7 cm), a second range from about 0 inches (0 cm) to about 1 inch (2.54 cm), and a third range from about 0.25 inches (0.64 cm) to about 0.75 inches (1.91 cm). In one embodiment, the distance 858 may be about 0.5 inches (1.27 cm). The second attachment point of the second end 854 may be located a distance 860 below the second hem 834. The distance 860 may have the same dimensional information as distance 858. The distance 858 may be the same as distance 860. In other embodiments, the distance 858 may be different than the distance 860.

Referring to FIG. 21, the first attachment point 870 may be a distance 874 from the first side edge 810. The second attachment point 872 may be a distance 875 from the first side edge 810. The strap 850 may have a distance 876 from the first attachment point 870 to an apex point 878. The relaxed length of the strap 850 from the attachment point 870 to the attachment point 872 may be less than the sum of the distance 874 and the distance 875. The distance 874 may have the same dimensional information as distance 174. The distance 875 may have the same dimensional information as distance 175. The distance 876 may have the same dimensional information as distance 176.

Figure 23:
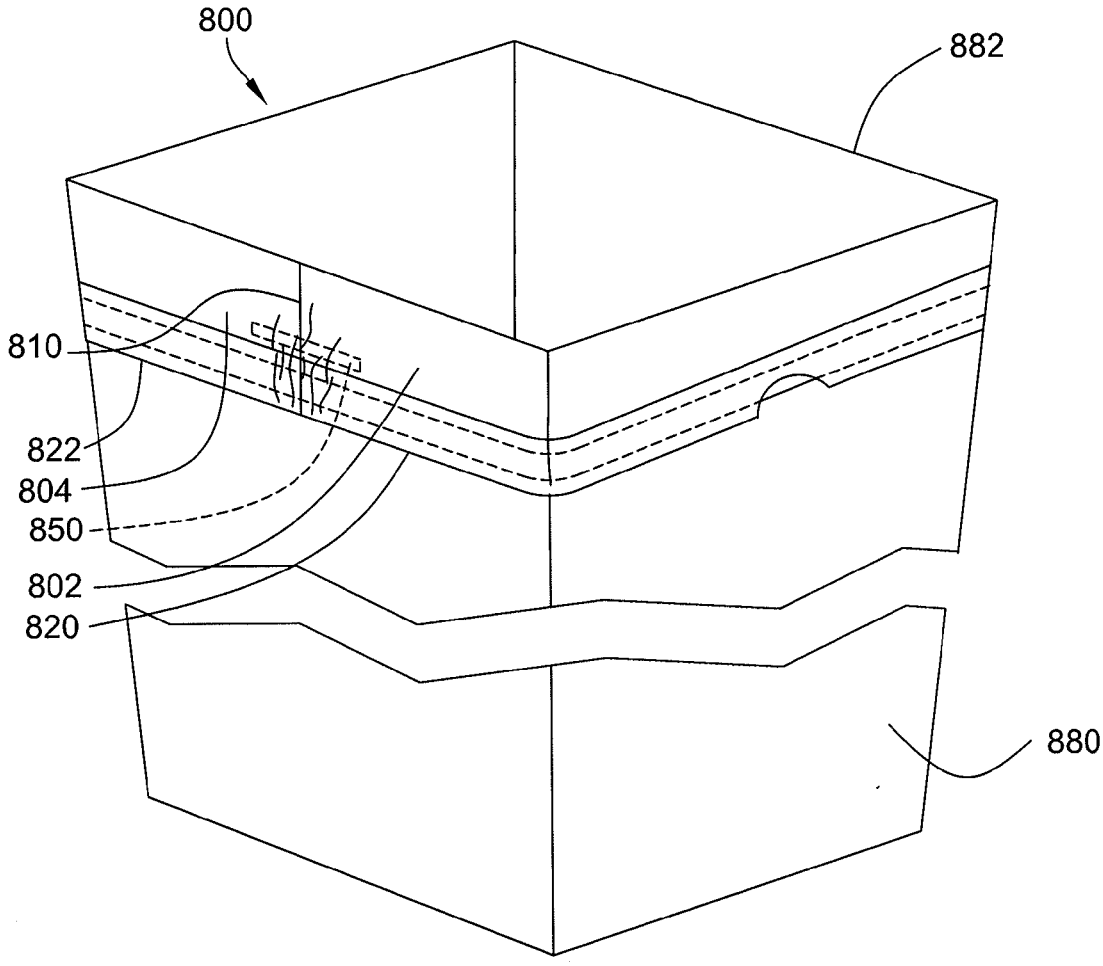
FIG. 23 is a perspective view of the bag of FIG. 21 inserted into a trash container with the opening folded about a rim of the container and the elastic strap securing the bag to the container.

Referring to FIG. 23, the elastic characteristic of the elastic strap 850 enables the strap to stretch when the bag 800 is installed on a trash receptacle 880. More specifically, the strap 850 may stretch or expand to become commensurate with the first side edge 810 when the first and second top edges 820, 822 are folded over the rim 882 of the receptacle. The elastic strap 850 may then relax or contract to pull the first and second side walls 802, 804 about the perimeter of the trash receptacle and may hold the bag to the receptacle.

In other embodiments, the first attachment point of one embodiment may be used with the second attachment point of another embodiment. For example in one embodiment, the elastic strap may have a first attachment point 170 of FIG. 5 and a second attachment point 372 of FIG. 11. In another example, an elastic strap may have a first attachment point 170 of FIG. 5 and a second attachment point 572 of FIG. 14.

Figure 24:
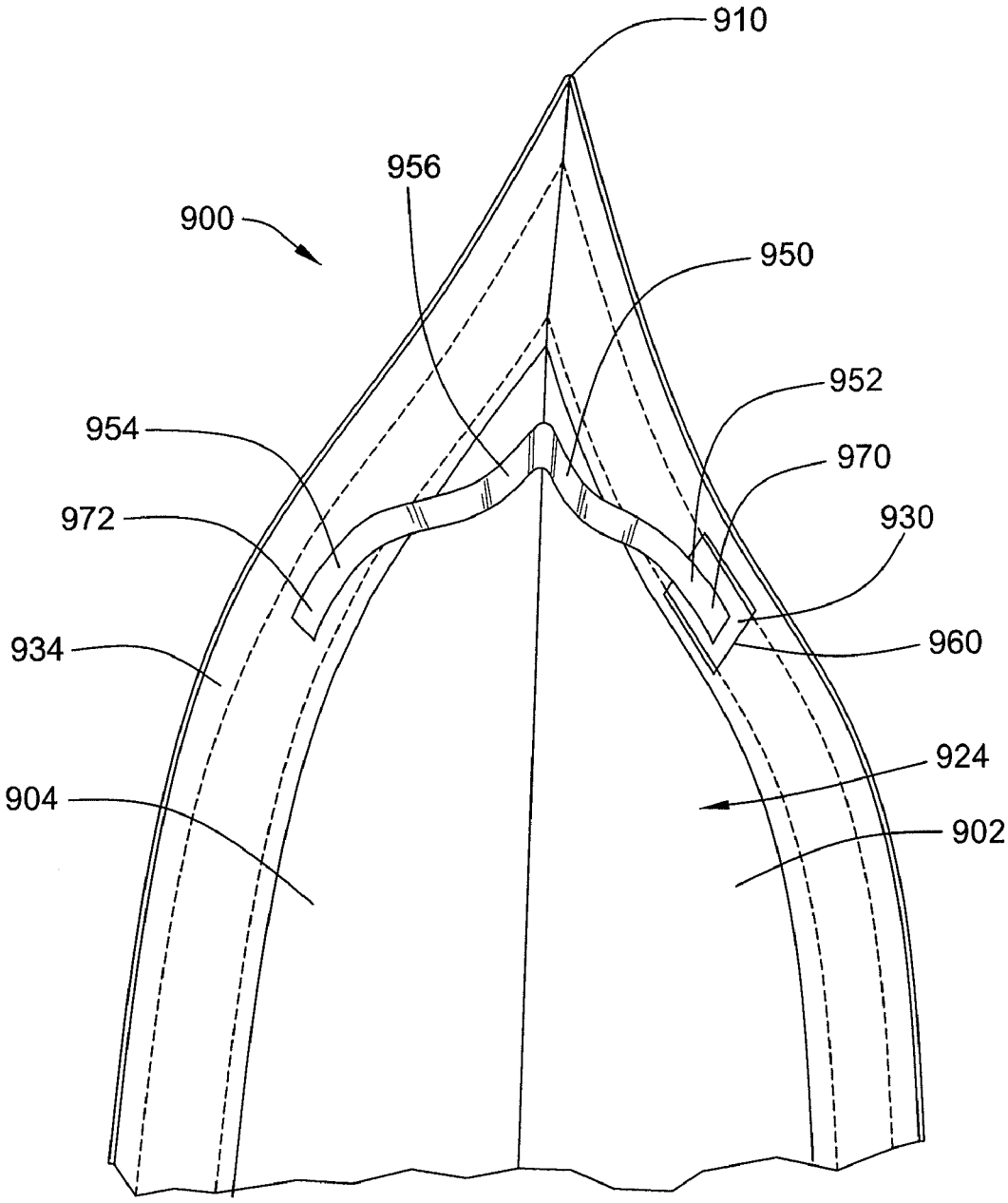
FIG. 24 is a partial top view of another embodiment.

Referring to FIG. 24, another embodiment of a bag 900 is shown. The bag 900 may be similar to bag 100 in FIG. 4 except that the second end 954 of the strap 950 may be attached to the hem 934 at attachment point 972. The attachment point 972 may be similar to the attachment point 372 in FIG. 11. The strap 950 may be attached at a first end 952 to an attachment point 970 associated with the first sidewall 902. The first end 952 may be attached to the draw tape 930 at attachment point 970. The first end 952 may be attached to the inside of the draw tape 930. The draw tape 930 may be accommodated in the first hem 932. The hem 932 may include an aperture 960 to expose the draw tape 930. The strap 950 may be attached at a second end 954 to an attachment point 972 associated with a second sidewall 904. The second end 954 may be attached to second hem 934. The second end 954 may be attached to the inside of the second hem 934. The intermediate length 956 of the strap may traverse the opening 924. The elastic strap 950 when relaxed may not extend to the first side edge 910. The elastic characteristic of the elastic strap 950 may allow a user to stretch the strap 950 outward proximate to or beyond the first side edge 910. The elastic strap 950 may provide a gripping force for holding the bag to the receptacle. The bag 900, including the strap 950 and the location of the attachment points, may have the same dimensional ranges and information as the bag 100 including the strap 150 and the locations of the attachment points, such as, distances 174, 175, 176, 179.

Figure 25:
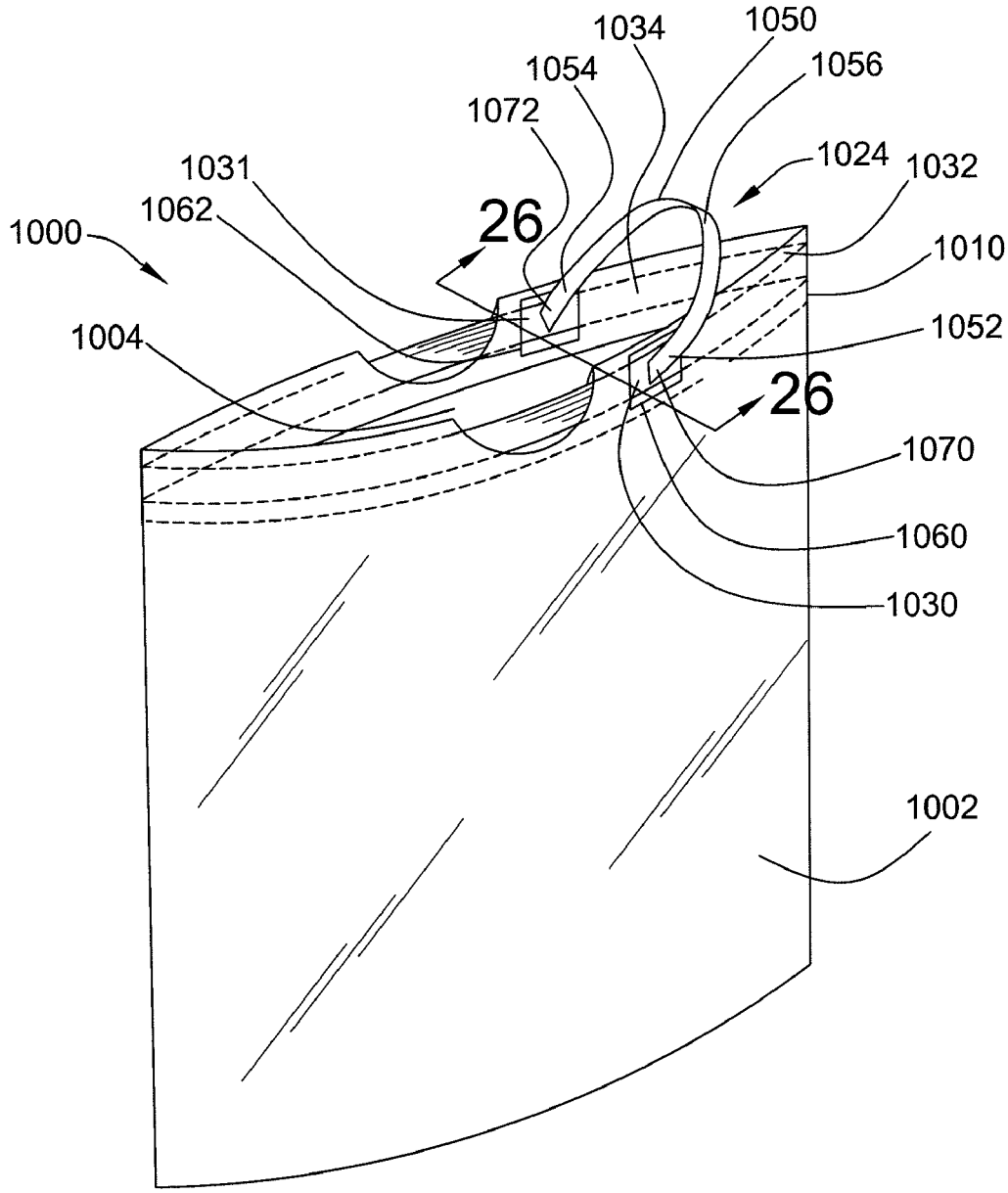
FIG. 25 is a perspective view of another embodiment.
Figure 26:
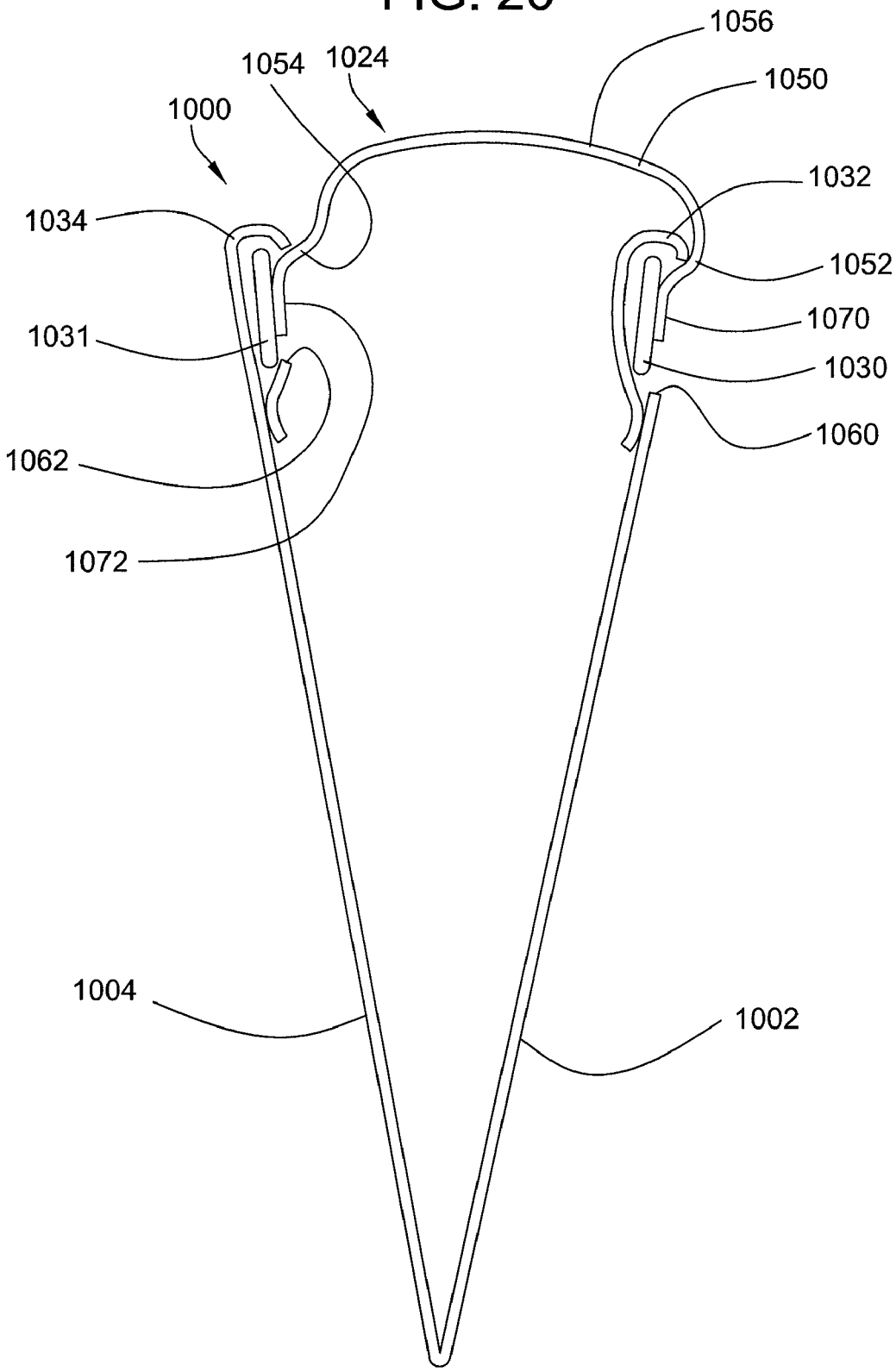
FIG. 26 is a cross-sectional view taken along line 26-26 in FIG. 25.

Referring to FIGS. 25 and 26, another embodiment of a bag 1000 is shown. The bag 1000 may be similar to bag 200 in FIG. 7 except that the second end 1054 of the strap 1050 may be attached to the draw tape at attachment point 1072. The attachment point 1072 may be similar to the attachment point 172 in FIG. 1. The strap 1050 may be attached at a first end 1052 to an attachment point 1070 associated with the first sidewall 1002. The first end 1052 may be attached to the draw tape 1030 at attachment point 1070. The first end 1052 may be attached to the outside of the draw tape 1030. The draw tape 1030 may be accommodated in the first hem 1032. The hem 1032 may include an aperture 1060 to expose the draw tape 1030. The strap 1050 may be attached at a second end 1054 to an attachment point 1072 associated with a second sidewall 1004. The second end 1054 may be attached to the draw tape 1031 at attachment point 1072. The second end 1054 may be attached to the inside of the draw tape 1031. The draw tape 1031 may be accommodated in the second hem 1034. The hem 1034 may include an aperture 1062 to expose the draw tape 1031. The intermediate length 1056 of the strap may traverse the opening 1024. The elastic strap 1050 when relaxed may not extend to the first side edge 1010. The elastic characteristic of the elastic strap 1050 may allow a user to stretch the strap 1050 outward proximate to or beyond the first side edge 1010. The elastic strap 1050 may provide a gripping force for holding the bag to the receptacle. The bag 1000, including the strap 1050 and the location of the attachment points, may have the same dimensional ranges and information as the bag 100 including the strap 150 and the locations of the attachment points, such as, distances 174, 175, 176, 179.

Figure 27:
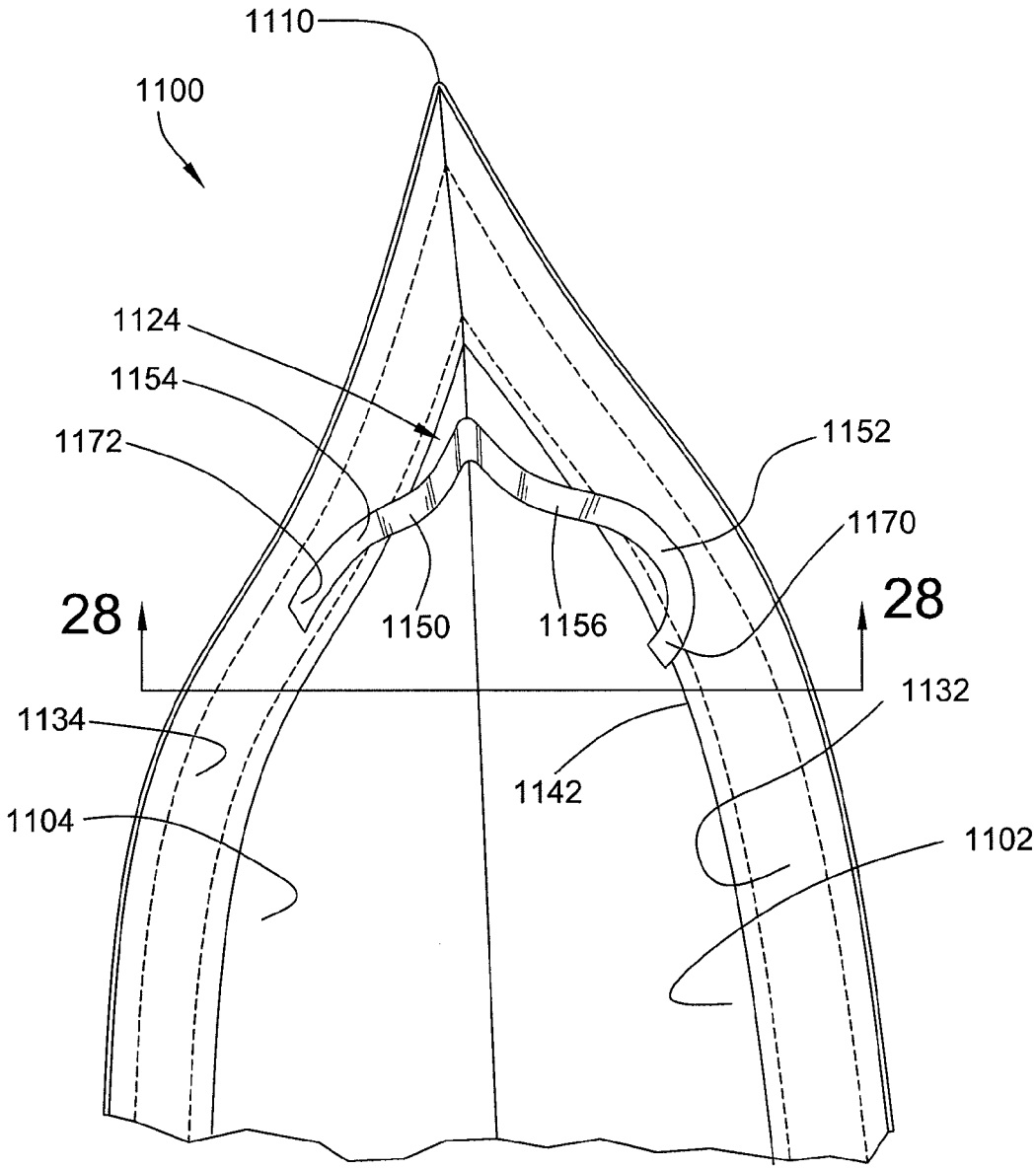
FIG. 27 is a partial top view of another embodiment.
Figure 28:
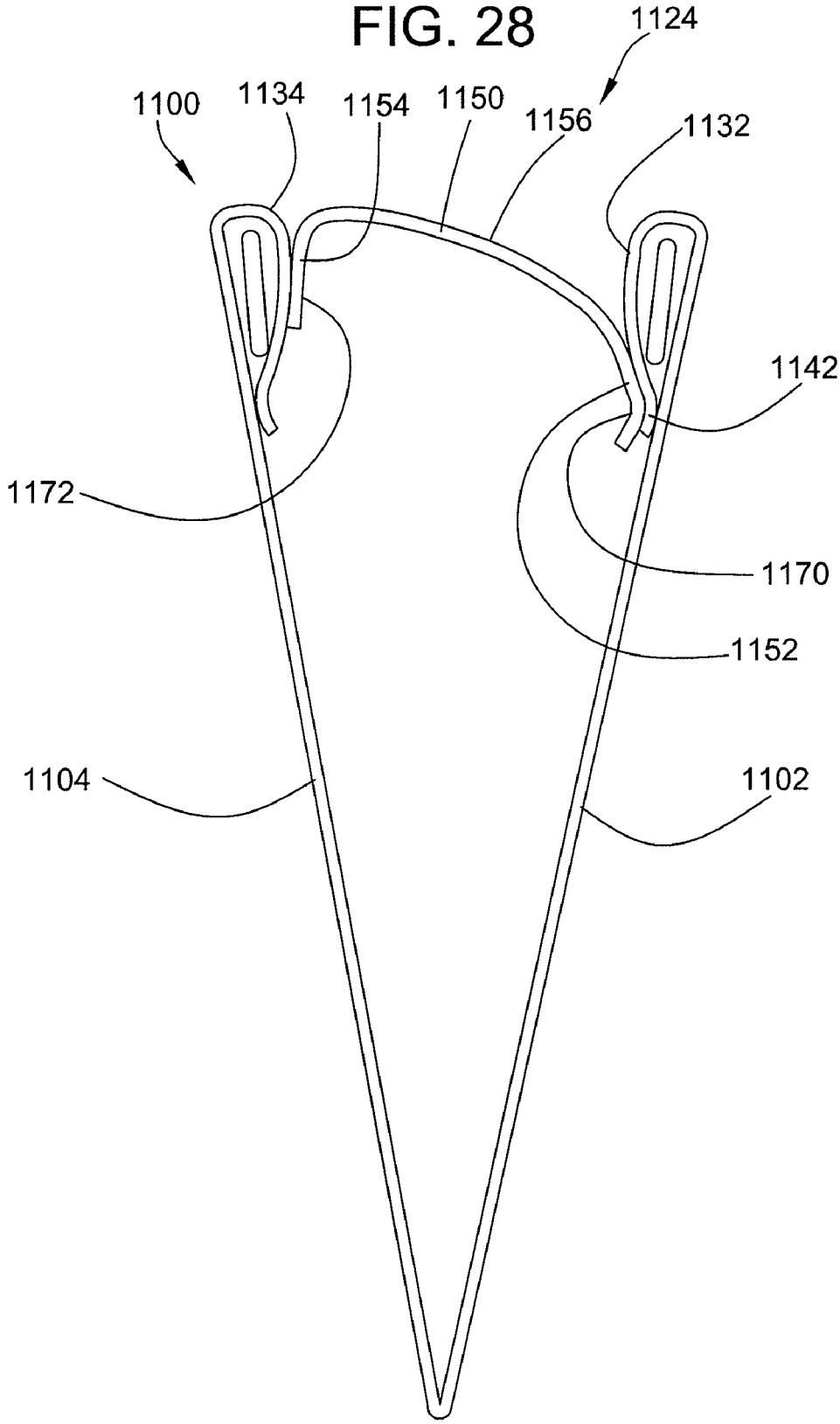
FIG. 28 is a cross-sectional view taken along line 28-28 in FIG. 27.

Referring to FIGS. 27 and 28, another embodiment of a bag 1100 is shown. The bag 1100 may be similar to bag 400 in FIG. 13 except that the second end 1154 of the strap 1150 may be attached to the hem 1134 at attachment point 1172. The attachment point 1172 may be similar to the attachment point 372 in FIG. 11. The strap 1150 may be attached at a first end 1152 to an attachment point 1170 associated with the first sidewall 1102. The first end 1152 may be attached to the hem 1132 at attachment point 1170. The first end 1152 may be attached to the hem seal 1142. The strap 1150 may be attached at a second end 1154 to an attachment point 1172 associated with a second sidewall 1104. The second end 1154 may be attached to the second hem 1134. The second end 1154 may be attached to the inside of the second hem 1134. The intermediate length 1156 of the strap may traverse the opening 1124. The elastic strap 1150 when relaxed may not extend to the first side edge 1110. The elastic characteristic of the elastic strap 1150 may allow a user to stretch the strap 1150 outward proximate to or beyond the first side edge 1110. The elastic strap 1150 may provide a gripping force for holding the bag to the receptacle. The bag 1100, including the strap 1150 and the location of the attachment points, may have the same dimensional ranges and information as the bag 100 including the strap 150 and the locations of the attachment points, such as, distances 174, 175, 176, 179.

Figure 29:
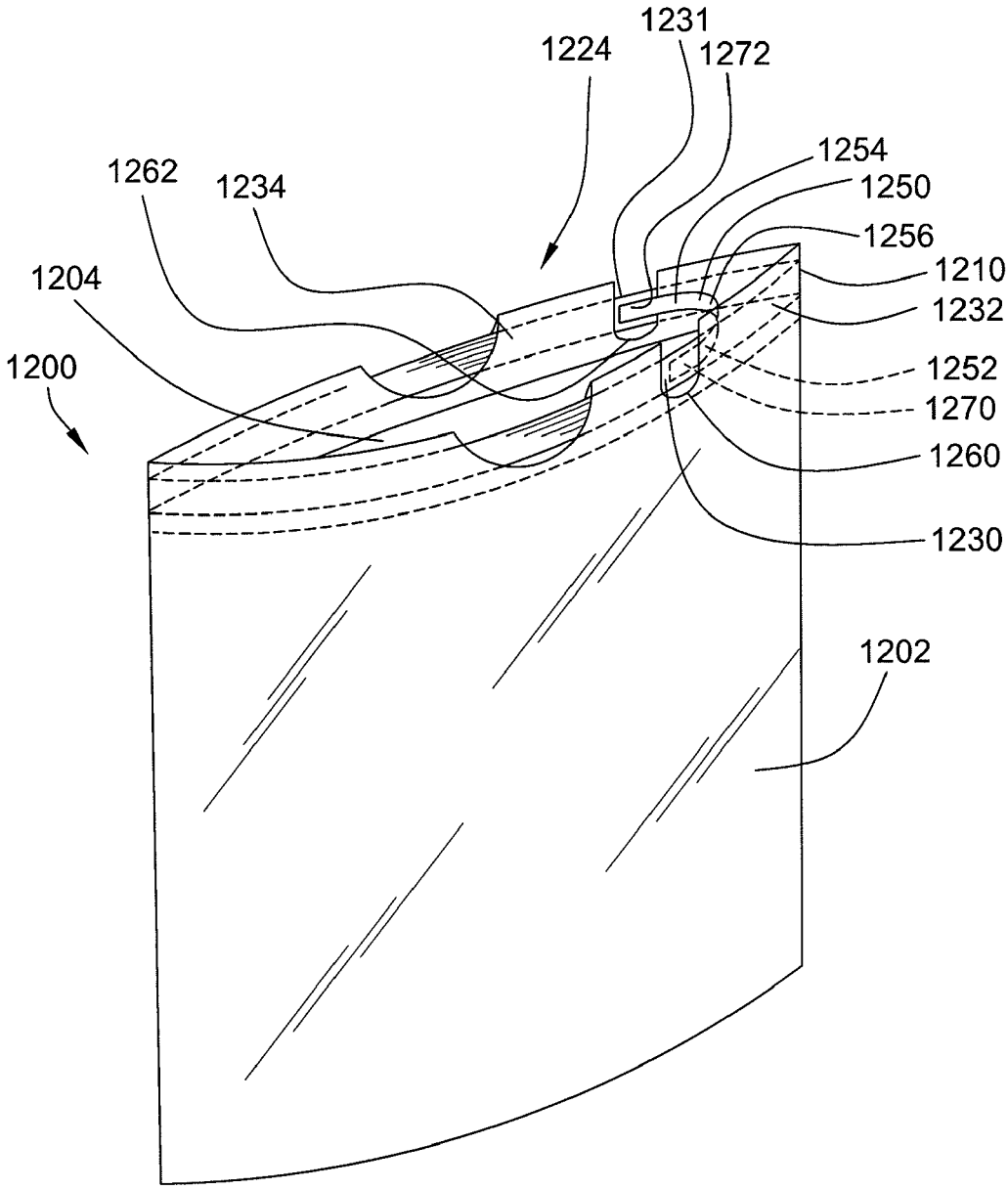
FIG. 29 is a perspective view of another embodiment.
Figure 30:
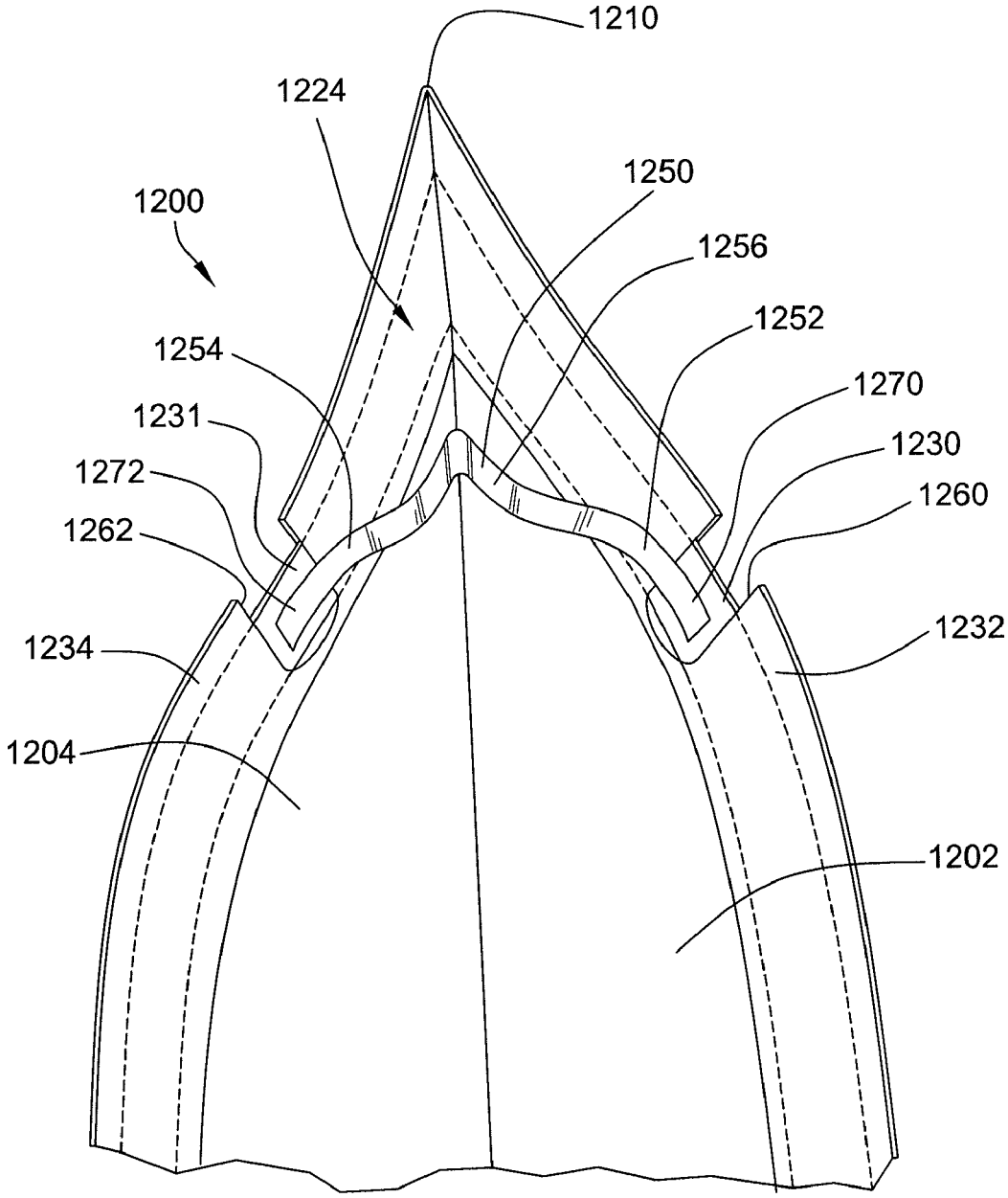
FIG. 30 is a partial top view of the bag in FIG. 29.

Referring to FIGS. 29-30, another embodiment of a bag 1200 is shown. The bag 1200 may be similar to bag 100 in FIG. 1 except that that the apertures 1260, 1262 may be notches. The strap 1250 may be attached at a first end 1252 to an attachment point 1270 associated with the first sidewall 1202. The first end 1252 may be attached to the draw tape 1230 at attachment point 1270. The first end 1252 may be attached to the inside of the draw tape. The draw tape 1230 may be accommodated in the first hem 1232. The hem 1232 may include an aperture 1260 to expose the draw tape 1230. The aperture 1260 may be a notch. The notch may be open at the top of the hem 1232. The strap 1250 may be attached at a second end 1254 to an attachment point 1272 associated with a second sidewall 1204. The second end 1254 may be attached to the draw tape 1231 at attachment point 1272. The second end 1254 may be attached to the inside of the draw tape. The draw tape 1231 may be accommodated in the second hem 1234. The hem 1234 may include an aperture 1262 to expose the draw tape 1231. The aperture 1262 may be a notch. The notch may be open at the top of the hem 1234. The intermediate length 1256 of the strap may traverse the opening 1224. The elastic strap 1250 when relaxed may not extend to the first side edge 1210. The elastic characteristic of the elastic strap 1250 may allow a user to stretch the strap 1250 outward proximate to or beyond the first side edge 1210. The elastic strap 1250 may provide a gripping force for holding the bag to the receptacle. The bag 1200, including the strap 1250 and the location of the attachment points, may have the same dimensional ranges and information as the bag 100 including the strap 150 and the locations of the attachment points, such as, distances 174, 175, 176, 179.

In other embodiments, the strap 1250 may be attached to the outside of one or both of the draw tapes. In other embodiments, the notches may have different shapes, such as, a circular notch, an oval notch, a square notch, a triangular notch, a hexagonal notch, other polygon shaped notches, asymmetric shaped notches, or other shapes of notches. In other embodiments, the aperture 1260 may have a different shape than the aperture 1262. The notches may be used with any of the embodiments described herein, as appropriate.

The bag may include additional features to facilitate its use as a trash receptacle liner. For example, a patterning may be imparted or embossed to all or part of the thermoplastic sidewalls to provide the bag with a stretchable or yieldable characteristic so that the bag may accommodate large or bulky items. Examples of such patterns and similar features are disclosed in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; and U.S. Pat. No. 6,695,476, each of which is herein incorporated by reference in its entirety.

Figure 31:
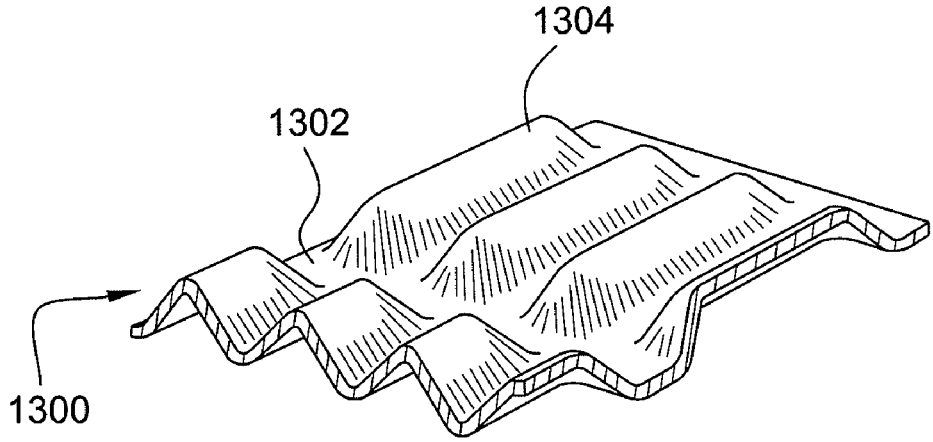
FIG. 31 is a perspective view illustrating a patterned thermoplastic material that may be used for the bag sidewalls, the material being formed to have a stretchable or yieldable characteristic, the material being in the un-stretched condition.
Figure 32:
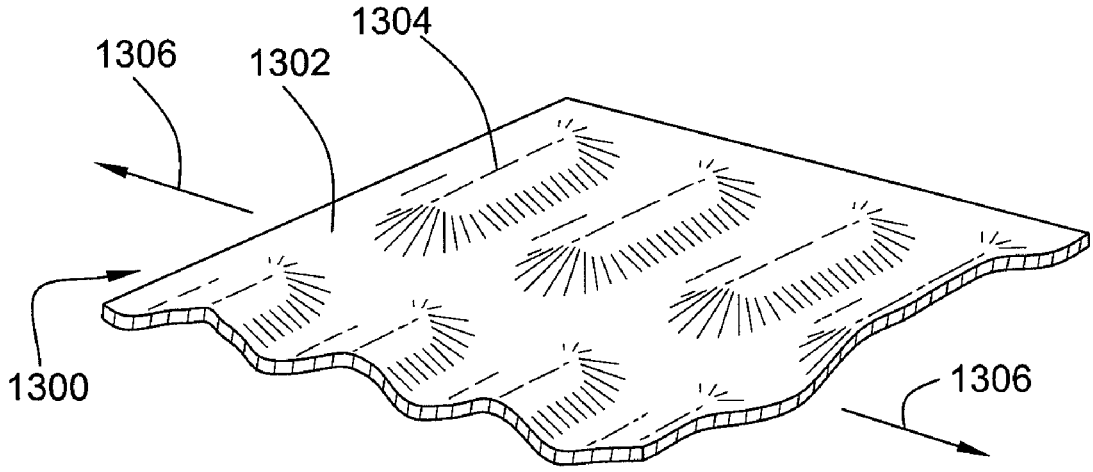
FIG. 32 is a perspective view similar to that of FIG. 31, illustrating the thermoplastic material as stretched out.

Referring to FIGS. 31 and 32, the pattern 1300 may be formed as a plurality of stretchable or strainable networks in which the normally planar, sheet-like thermoplastic material of the first and second sidewalls may be bunched together in a series of parallel wrinkles or creases. These include a plurality of first regions 1302 that may correspond to the planar sheet of the sidewall and a plurality of second regions 1304 formed as rib-like elements that may protrude from the plane of the first regions and that may appear bunched or contracted together when in an un-tensioned state illustrated in FIG. 31. When a pulling force 1306 is applied as indicated in FIG. 32, the rib-like second regions may be able to unbend or geometrically deform so that the first and second regions may become substantially co-planar with each other. This unbunching action may stretch or elongate the pattern thereby adding to the overall area of the sidewalls. Thus, the bag may expand or increase in volume when large or bulky items are inserted into it and come into contact with the sidewalls. This stretching and yielding of the sidewalls may help absorb and dissipate the force otherwise created by the inserted object thereby improving the toughness and durability of the bag. The thermoplastic material into which the pattern 1300 is imparted may demonstrate shape memory causing the first and second regions to return to the geometry of the un-tensioned state illustrated in FIG. 31 when the applied forces are removed.

Figures 33, 34:
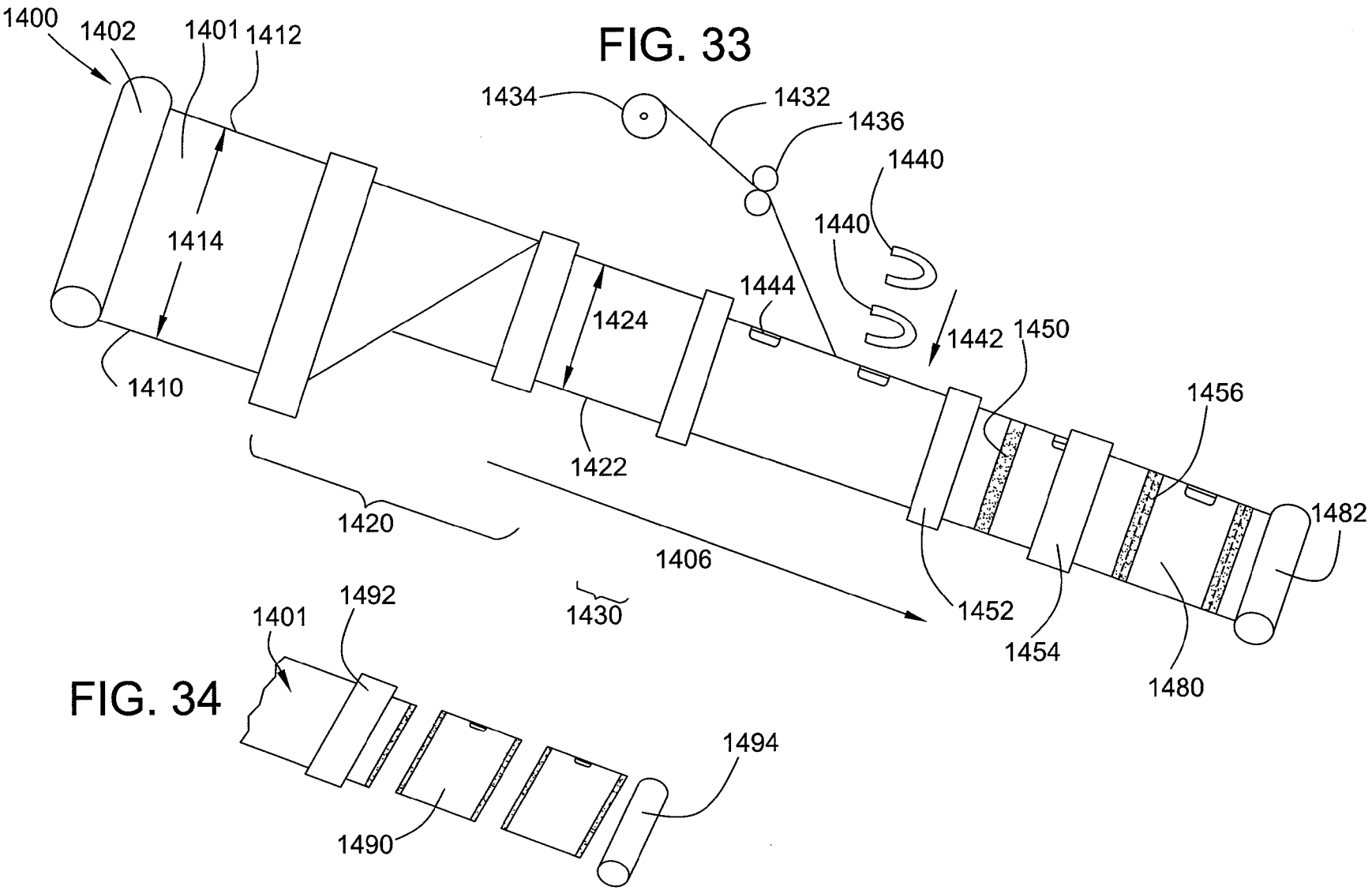
FIG. 33 is a schematic representation of a high speed manufacturing process for producing thermoplastic bags of the foregoing type.
FIG. 34 is a schematic representation of another embodiment of a manufacturing process.

Bags of the aforementioned type may be produced in a high speed, automated manufacturing process such as that illustrated in FIG. 33. The illustrated manufacturing process 1400 may include automated equipment and arranged stations that may convert continuous sheet-like webs of planar, thermoplastic material into the finished bags. The webs may initially be provided in roll of thermoplastic sheet material. For example, a first web 1401 of flexible thermoplastic material may be unwound from a first roll 1402 and movingly directed along a machine direction 1406 by the processing equipment. When unwound, the first web 1401 may have a first side edge 1410 and a second side edge 1412 that define a width 1414 that may be perpendicular to the machine direction 1406.

To provide the enclosed interior volume of the finished bag, the web 1401 may be folded in half orthogonally about the machine direction 1406 by a folding operation 1420. When folded in half, the first and second side edges 1410, 1412 may be moved adjacent to each other. The width 1424 of the folded web 1401 may be half of the width 1414 of the unfolded web. Moreover, once folded, the center of the web 1401 provides an outer edge 1422 that may correspond to the bottom edge of the finished bag. In another embodiment, the roll 1402 may have a pre-folded web and the folding operation is not necessary.

The process may include equipment that provides for installing the draw tapes within the hems. For example, in a hem-forming operation 1430, the adjacent edges 1410, 1412 of the web may be folded inwardly parallel to the machine direction 1406 to provide the channel-like hems. The draw tape may be formed from a continuous strip 1432 of thermoplastic material that is unwound from a roll 1434 and directed by appropriately placed rollers 1436 to run parallel to the machine direction 1406 and between the folded over edges 1410, 1412 of the web 1401. A plurality of elongated elastic straps 1440 may be provided and may be attached by their ends to the advancing web 1401 by an attachment operation 1442. Depending upon the embodiment being made, apertures may be provided in one or more hems so that the elastic strap may be attached to one or more draw tapes. Additionally, notches 1444 may be disposed into the web to expose the installed strip 1432 that will become the draw tape.

To provide the side edges of the finished bag, side seals 1450 may be formed into the web 1401 at intermittent spaces along the web and may be perpendicular to the machine direction 1406. The spaced apart seals may be symmetrical and identical to each other. The seals 1450 may be formed as generally straight, continuous lines that extend between the aligned edges 1410, 1412 and the edge 1422 of the folded web. To form the seals, the advancing web 1401 may be directed through a sealing operation 1452 in which heated bars or rollers may be pressed against the web to form heat seals in the thermoplastic material. The sealing operation may also fixedly attach together the thermoplastic web and the draw tape that is accommodated in the folded-over side edges 1410, 1412 corresponding to the hems. In another embodiment, the elastic straps 1440 may be attached to the web after the sealing operation 1452 has been completed.

After forming the side seals 1450, the web 1401 may be directed through a perforating operation 1454 in which perforations 1456 are made at the side seals 1450. In another embodiment, the web may be folded one or more times before the web is perforated. Thus, individual bags 1480 may be detached from the web 1401 at the perforations 1456. The individual bags 1480 which are attached to each other may be directed into a roll 1482. The roll 1482 may be placed in a box or bag for sale to a customer. The user may then detach the bags from the roll along the perforations 1456.

In another embodiment, referring to FIG. 34, the individual bags 1490 may be detached and separated from the other bags on the processed web by a cutting operation 1492. In another embodiment, the web may be folded one or more times before the web is cut. The individual bags 1490 may be packaged for distribution. For example, the bags 1490 may be wound into a roll 1494 for packaging and distribution. For example, the roll 1494 may be placed in a box or bag for sale to a customer. The bags 1490 may be interleaved prior to winding into the roll 1494. In another embodiment, the bags 1490 may be positioned in a box or bag, and not onto the roll 1494. The bags 1490 may be interleaved prior to positioning in the box or bag.

Additional equipment may be included for applying patterns to the thermoplastic web as discussed above.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermoplastic bag for use as a trash receptacle liner bag comprising:

a first sidewall of pliable thermoplastic material;

a second sidewall of pliable thermoplastic material overlaid and joined to the first sidewall along a first side edge, a second side edge, and a bottom edge to provide an interior volume, the interior volume accessible via an opening provided by first and second top edges of the respective first and second sidewalls;

a first draw tape accommodated in a first hem;

a second draw tape accommodated in a second hem;

an elastic strap with a first end and a second end, the elastic strap attached at the first end to a first attachment point associated with the first sidewall and attached at the second end to a second attachment point associated with the second sidewall, wherein the first attachment point is on the first draw tape, the second attachment point is on the second draw tape, and wherein the elastic strap passes through a first aperture disposed in the first hem and a second aperture disposed through the second hem.

2. The thermoplastic bag of claim 1, wherein the first aperture is a notch and the second aperture is a notch.

3. A thermoplastic bag for use as a trash receptacle liner bag comprising:

a first sidewall of pliable thermoplastic material;

a second sidewall of pliable thermoplastic material overlaid and joined to the first sidewall along a first side edge, a second side edge, and a bottom edge to provide an interior volume, the interior volume accessible via an opening provided by first and second top edges of the respective first and second sidewalls;

a first draw tape having an interior surface and an exterior surface and accommodated in a first hem;

a second draw tape having an interior surface and an exterior surface and accommodated in a second hem;

an elastic strap with a first end and a second end, the elastic strap attached at the first end to a first attachment point associated with the first sidewall and attached at the second end to a second attachment point associated with the second sidewall, wherein the first attachment point is on the first draw tape, and the second attachment point is on the second draw tape, and wherein the first attachment point is on the exterior surface of the first draw tape and the second attachment point is on the interior surface of the second draw tape.

4. A thermoplastic bag for use as a trash receptacle liner, liner bag comprising:

a first sidewall of pliable thermoplastic material;

a second sidewall of pliable thermoplastic material overlaid and joined to the first sidewall along a first side edge, a second side edge, and a bottom edge to provide an interior volume, the interior volume accessible via an opening provided by first and second top edges of the respective first and second sidewalls;

a first draw tape accommodated in a first hem;

an elastic strap with a first end and a second end, the elastic strap attached at the first end to a first attachment point associated with the first sidewall and attached at the second end to a second attachment point associated with the second sidewall;

wherein a second draw tape is accommodated in a second hem, the first attachment point is on the first draw tape and the second attachment point is on the second hem.

* * * * *